US008660683B2

(12) United States Patent
Goldman et al.

(10) Patent No.: US 8,660,683 B2
(45) Date of Patent: Feb. 25, 2014

(54) PRINTER DRIVER SYSTEMS AND METHODS FOR AUTOMATIC GENERATION OF EMBROIDERY DESIGNS

(75) Inventors: David A. Goldman, Vestal, NY (US); Nirav Patel, Johnson City, NY (US); Mingkui Song, Binghamton, NY (US)

(73) Assignee: Vistaprint Schweiz GmbH, Winterthur (CH)

( * ) Notice: Subject to any disclaimer, the term of this patent is extended or adjusted under 35 U.S.C. 154(b) by 0 days.

(21) Appl. No.: 13/346,338

(22) Filed: Jan. 9, 2012

(65) Prior Publication Data

US 2012/0109358 A1 May 3, 2012

Related U.S. Application Data

(63) Continuation of application No. 11/556,008, filed on Nov. 2, 2006, now Pat. No. 8,095,232.

(60) Provisional application No. 60/732,831, filed on Nov. 2, 2005.

(51) Int. Cl.
*D05C 5/02* (2006.01)

(52) U.S. Cl.
USPC ..... 700/138; 112/470.01

(58) Field of Classification Search
USPC ..... 700/136–138; 112/470.01, 470.06, 112/475.19
See application file for complete search history.

(56) References Cited

U.S. PATENT DOCUMENTS

| | | | | |
|---|---|---|---|---|
| 4,991,524 | A | 2/1991 | Ozaki | |
| 5,191,536 | A | 3/1993 | Komuro et al. | |
| 5,320,054 | A * | 6/1994 | Asano | 112/102.5 |
| 5,410,976 | A * | 5/1995 | Matsubara | 112/470.06 |
| 5,823,127 | A * | 10/1998 | Mizuno | 700/138 |
| 6,010,238 | A | 1/2000 | Kotaki | |
| 6,397,120 | B1 | 5/2002 | Goldman | |
| 6,629,015 | B2 | 9/2003 | Yamada | |
| 6,690,988 | B2 | 2/2004 | Kaymer et al. | |
| 6,968,255 | B1 | 11/2005 | Dimaridis et al. | |
| 7,228,195 | B2 | 6/2007 | Hagino | |
| 2002/0007228 | A1 | 1/2002 | Goldman | |
| 2002/0038162 | A1 | 3/2002 | Yamada | |
| 2003/0074100 | A1 * | 4/2003 | Kaymer et al. | 700/138 |
| 2004/0243272 | A1 | 12/2004 | Goldman | |
| 2004/0243273 | A1 | 12/2004 | Goldman | |
| 2004/0243274 | A1 | 12/2004 | Goldman | |
| 2004/0243275 | A1 | 12/2004 | Goldman | |
| 2010/0106283 | A1 | 4/2010 | Harvill et al. | |
| 2010/0108754 | A1 | 5/2010 | Kahn | |

OTHER PUBLICATIONS

Song et al., "Algorithms for Vector Graphic Optimization and Compression," Advances of Computer Graphics, 2006, pp. 665-672, Springer-Verlag, Berlin/Heidelberg. (8 pages).

* cited by examiner

*Primary Examiner* — Nathan Durham
(74) *Attorney, Agent, or Firm* — Hanley, Flight & Zimmerman, LLC

(57) ABSTRACT

Printer driver systems and methods for automatic generation of embroidery designs are disclosed. An example method includes identifying intersections of line segments from different ones of first polygonal objects, determining relationships between the line segments based on the intersections, removing a redundancy between at least two of the line segments, generating, using a computer, second polygonal objects based on the intersections and the line segments, and outputting, from the computer, embroidery data representative of the second polygonal objects.

16 Claims, 28 Drawing Sheets

(a) Scan line at event A (b) Scan line at event D

Stroke Path Calculations of Round End Cap

Stroke Path Calculations of
Square End Cap
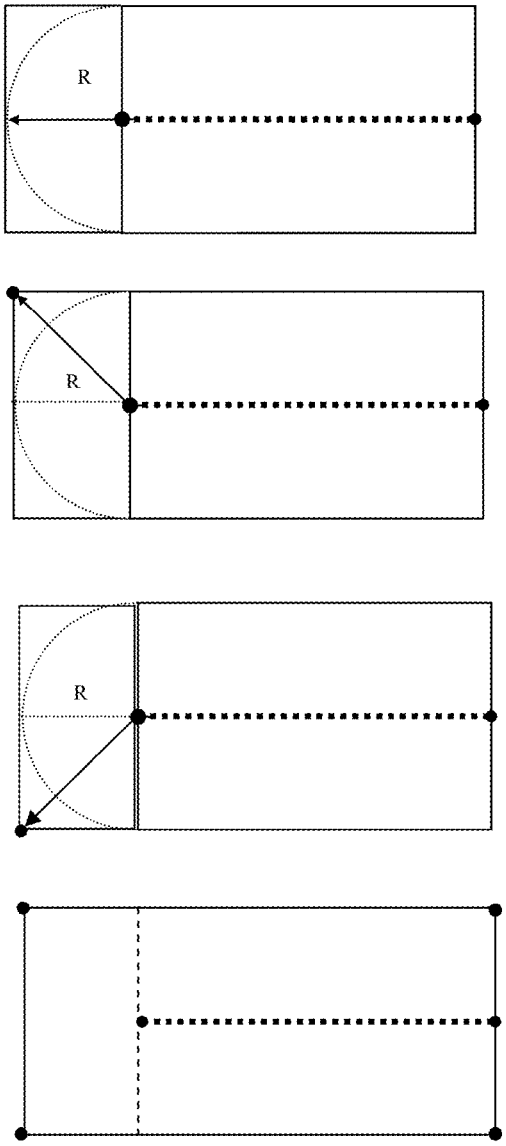
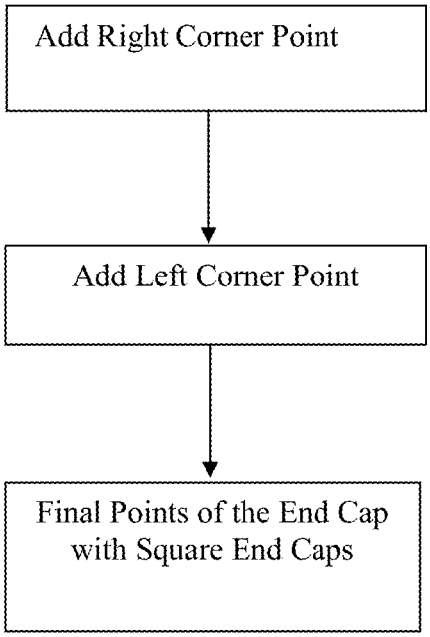
Figure 15

```
Depth = 1
n = number of segments on the scanline
Segment[0].flag = Left
StartOrder = Segment[0].Y_increasing  // bool flag set if segment is going down
For i = 1 to n
    If Segment[i] not paired
        if Segment[i].Y_increasing is equal to StartOrder
            Depth++
        else
            Depth- -
    If Depth is equal to 0
        Segment[i].flag = Right
    if Depth is equal to 1
        Segment[i].flag = Left
    StartOrder = Segment[i].Y_increasing
```

Figure 22

```
1. S^0 = First segment intersects with scan ray from left to right;
2. Stack.Push(S^0_Face)
3. For k=0 to n do
4.     S^k = k^th segment intersects with scan ray from left to right
5.     Face_active = Stack.GetTopElement;  (do not pop off the stack)
6.     If S^k_face is younger than Face_active
7          if Color[S^k_face] == Color[Face_active]
8.             State(S^k) = Invalid      //elimination
9              if the right pair segment of Face_active left segment between S^k pair
10.                State(right pair segment of Face_active) = Invalid
11.        else
12.            if S^k is valid
13.                Select S^k              //selection
14.                Duplicate S^k to Face_active segment pool   //duplication
15.    If (IsLeftSegment(S^k)
16.        Stack.Push(S^k_face)
17.    If (IsRightSegment(S^k)
18.        Stack.PopOff(S^k_face)
```

Figure 23

*Coincident/Overlapped Segments Selection Criteria:*

(1) $S_{left} - S_m$ and $S_{right} - S_n$ shall not be selected/moved to any segment pool.

(2) $S_m$ is NOT selected if any of the following conditions are true:

(i) if $S_{right} \neq \emptyset$ and Attributes($S_{face}(m)$) = Attributes($S_{face}(n)$) ;

(ii) $S_m$ is between youngest pair $\{SL_k, SR_k\}$, if $m < k$, or Attributes($S_{face}(m)$) = Attributes($S_{face}(k)$) .

(3) $S_n$ is NOT selected if any of the following conditions are true:

(i) if $S_{left} \neq \emptyset$ and Attributes($S_{face}(n)$) = Attributes($S_{face}(m)$) ;

(ii) $S_n$ is between youngest pair $\{SL_k, SR_k\}$, if $n < k$ or Attributes($S_{face}(n)$) = Attributes($S_{face}(k)$) .

*Coincident/Overlapped Segments Duplication Criteria:*

(1) $S_{left} - S_m$ and $S_{right} - S_n$ shall not be duplicated/copied to any segment pool.

(2) $S_m$ should be duplicated only if (i) $S_m$ is not between any segment pair. Or (ii) $S_m$ is between a youngest pair $\{SL_k, SR_k\}$ such that $m > k$ and Attributes($S_{face}(m)$) $\neq$ Attributes($S_{face}(k)$) and $S_{right} = \emptyset$.

(3) $S_n$ can be duplicated only if (i) $S_n$ is not between any segment pair. Or (ii) $S_n$ is between a youngest pair $\{SL_k, SR_k\}$, such that $n > k$ and Attributes($S_{face}(n)$) $\neq$ Attributes($S_{face}(k)$) and $\{S_{left}\} = \emptyset$;

Figure 24

```
FindBoundaryIntersections (Q, S, τ )
    1. while Q is not empty
    2.     p= DEQUEUE(Q)
    3.     HandleEventPoint(p, S, τ)
HandleEventPoint(p, S, τ )
    1. If τ is empty
    2.     Select U (P) from S and store them into τ
    3.     If U(P) is not empty
    4.         Call FixDuplicateSlopes for segments in U(P)
    5.         If segments in U (P) are from different polygonal objects,
    6.             report P as an intersection
    7.     Return
    8. UpdateStatusKey ( τ )
    9. Select all C(P) from τ , and break into L(P) and U(P).
    10. Insert U(P) into S.
    11. Delete L(P) and U(P) segments from τ
    12. Assign L_bound = S_l(p) and R_bound = S_r(p) from τ
    13. Select U (P) from S and store them into τ
    14.     If U(P) from τ is not empty
    15.         Call FixDuplicateSlopes for segments in U(P).
    16.     If segments in U(P) are from different polygonal objects
    17.         Report P as an intersection
    18.     If segments in U (P) and L(P) are from different polygonal objects
    19.         Report P as an intersection
    20. Assign L_ray = Ml(U(p)) and R_ray = Mr(U(p)) from U(P)
    21. If segments from U(P) and L(P) are not from a single polygonal object
    22.     Report P as an intersection
    23. If U(p) is empty
    24.     Then FindNewEvent(L_bound , R_bound, p)
    25. Else
    26.     FindNewEvent (L_bound , L_ray , p)
    27.     FindNewEvent(R_ray , R_bound , p);
FindNewEvent (leftSegment, rightSegment, p)
    1. IntersectionPoint = FindIntersect(leftSegment, rightSegment);
    2. If IntersectionPoint is below the sweep line, or on it and to the right of the current event point p
    3.     insert IntersectionPoint into Q
    4. if leftSegment and rightSegment are from different polygonal objects,
    5.     report p as an intersection
FixDuplicateSlopes
    1. While any two segments in U (P) have the same slope, but different lengths
    2.     split the longer segment into two segments that connect at the endpoint of the original
           shorter segment
    3.     Report the newly added endpoint as an intersection (i.e. for event point processing)
FindIntersect(SegmentA, SegmentB)
    1. Test the intersection of SegmentA and B using algebraic predicates as described in [BP00].
```

Figure 25

PRINTER DRIVER SYSTEMS AND METHODS FOR AUTOMATIC GENERATION OF EMBROIDERY DESIGNS

RELATED APPLICATIONS

This patent arises from a continuation of U.S. patent application Ser. No. 11/556,008, filed on Nov. 2, 2006, which is a non-provisional of U.S. provisional patent application No. 60/732,831, filed on Nov. 2, 2005, entitled "PRINTER DRIVER SYSTEMS AND METHODS FOR AUTOMATIC GENERATION OF EMBROIDERY DESIGNS," the entireties of which are hereby incorporated by reference.

TECHNICAL FIELD

The present disclosure pertains to automatic generation of embroidery designs and, more particularly, to printer driver systems and methods for automatic generation of embroidery designs.

BRIEF DESCRIPTION OF THE DRAWINGS

FIG. 4 shows an original printing file containing three overlapping polygons [two red, one blue (with a hole)]. The output contours (here 5 polygons) are shown on the right.

FIG. 15: Illustration of an example method and generate square end-cap stroke path outlines.

FIG. 22: Represents the process or machine readable and executable instructions to find segment pairs when a winding-rule fill mode is specified.

FIG. 23: Represents the process or machine readable and executable instructions delineating the general elimination, selection and duplication process.

FIG. 24: Modified segment arrangement criteria for the situation of multiple coincident segments.

FIG. 25: Polygonal Intersection Processes.

DESCRIPTION

Printer drivers are traditionally software programs that facilitate communication between an operating system's printing sub-system and an actual hardware device that physically imprints a particular type of substrate. While considerable complexity may exist in the implementation of a printer driver, from the end user's perspective, utilization of such a driver appears simply as part of a seamless process whereby the user selects a "print" command under a given application running within the operating system and then the active document within that application is visually reproduced on the desired printing device. Under some circumstances, printer drivers are used to produce output that is not directly communicated to an actual hardware device. In such cases, the printing device may be referred to as a "virtual" printer in that it may exist to primarily produce electronic files (e.g. image or typesetting files such as jpeg's, bmp's or pdf's). Once created, these files may then be subsequently viewed, transferred or edited by the user for a variety of purposes.

The method described here specifies a printer driver that can be thought of in either sense (i.e. traditional or virtual) and is unique in that it produces output that effectively reproduces printed documents as embroidered designs. This output when connected to actual hardware such as an embroidery machine allows the machine to appear to the computer operator as simply another printer to which documents may be easily sent. When not connected to hardware, the driver provides the functionality of a virtual printer whereby an embroidery data file may be generated that effectively encompasses the complete specification of an embroidery design. This data file may then be used to view a pictorial representation of embroidery data on a computer screen for editing or further manipulation. Alternatively, this data file may also be manually transferred as input to embroidery equipment where the file presents all data necessary for the equipment to sew out or produce the related embroidery design on material or a provided garment. In another embodiment, this data file can be transferred to a web-service to be embroidered on apparel like T-shirts or hats. The actual transfer may be done using many different protocols like html, low-level sockets, web-service protocols like SOAP, XML-RPC, etc. The printer driver may transfer the low level vector graphics information to the web-service, which then generates embroidery data based on that information. The user is then directed to the web-page through a browser, where he can manipulate the design and select garments on which he wants the design embroidered. After the user confirms the selection the, embroidered garments are delivered to him.

Figure 1:
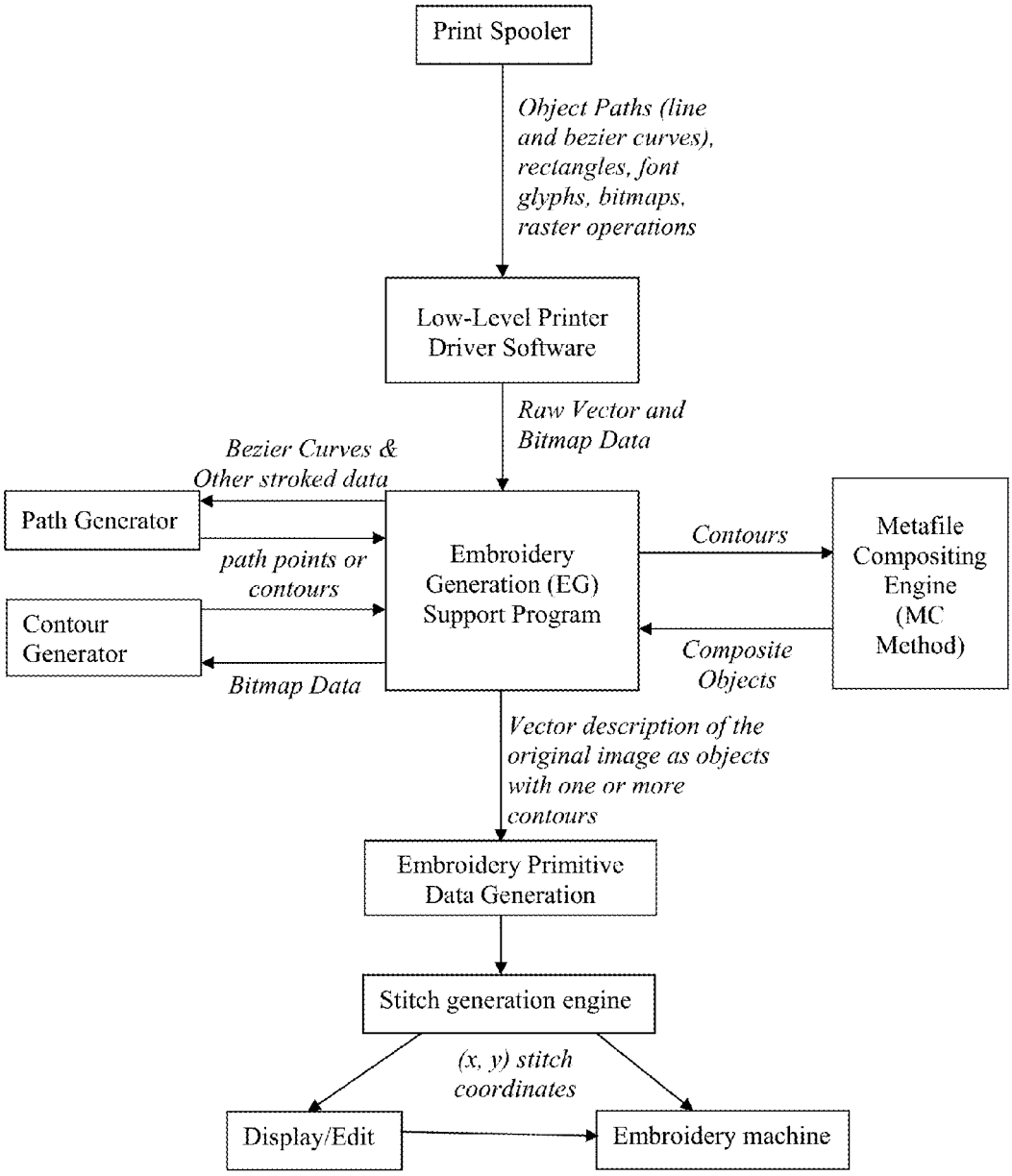
FIG. 1: Example printer driver system for generating embroidery designs when printing documents via a general purpose computer operating system
Figure 2:
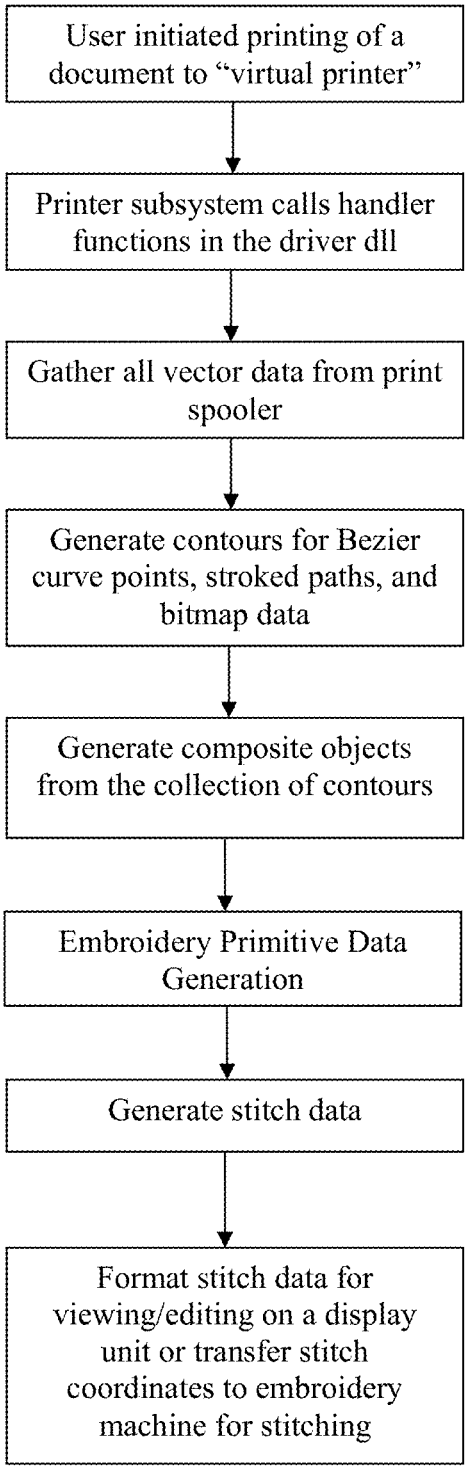
FIG. 2: Example operations of the example printer driver system of FIG. 1.
Figure 3:
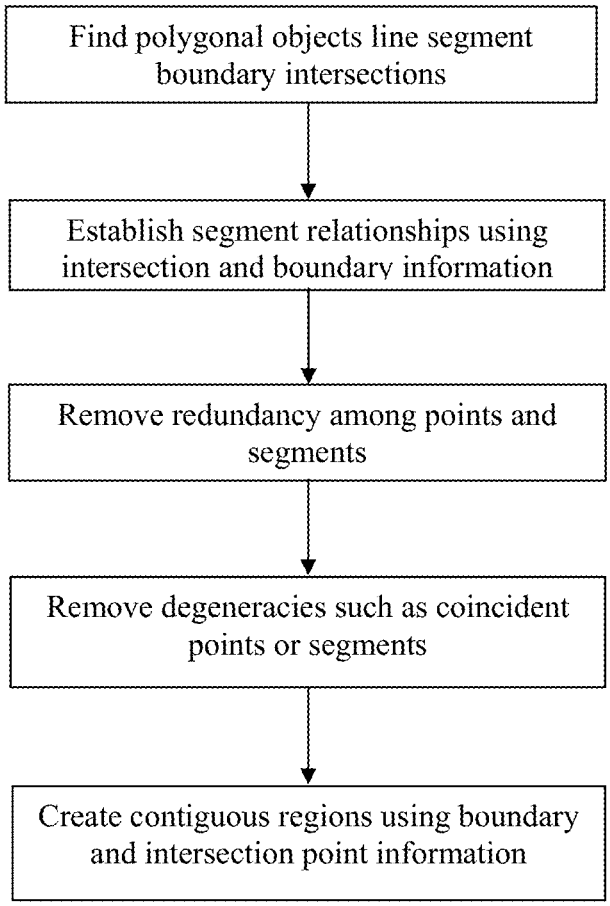
FIG. 3: Example operations of an example compositing method used by the printer driver system of FIG. 1.
Figure 4:
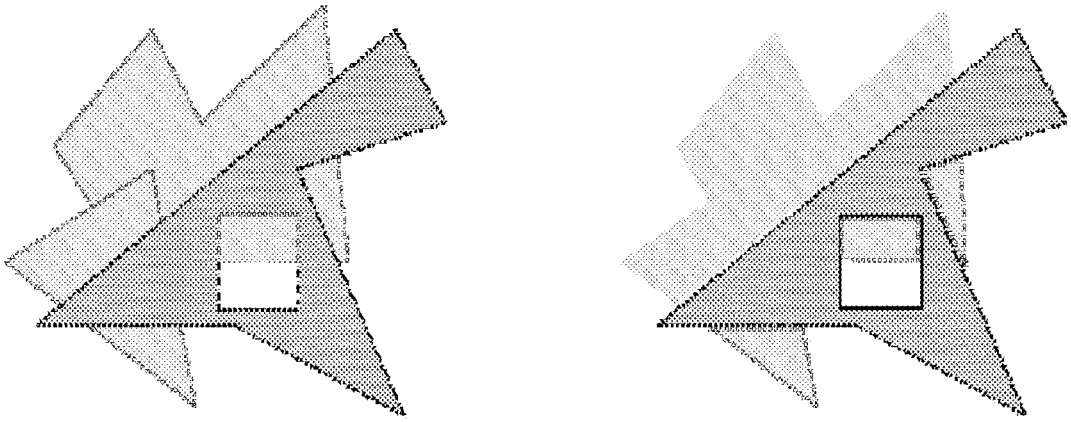
FIG. 4: Example of Compositing Input Records for a Printing File Containing Three Overlapping Polygons.
Figure 5:
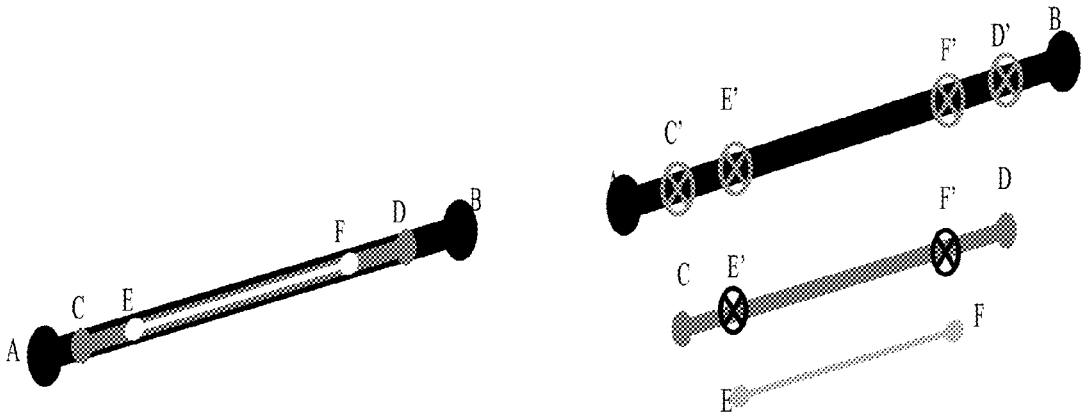
FIG. 5: An example illustration of handing collinear cases: Lines [AB], [CD] and [EF] are collinear segments. Points C, E, F, D are reported as intersection points. As a result, four intersection points are inserted into line [AB], two points are inserted into line [CD]. Note: collinear segments are handled in lines 4 and 15 without increasing the degree of the algorithm.

The embroidery process is substantially different from other more traditional imprinting technologies such as CMYK inkjet processes or screen printing processes. Images are created on fabric using embroidery by placing sequences of stitches at various locations, with various orientations, using a multitude of thread colors. One common type of information stored within embroidery data relates to the relative locations of needle penetration points. This information is often stored using a Cartesian coordinate system (e.g. sequences of x, y values representing the horizontal and vertical location of each needle penetration and subsequently the end point locations for stitches which may be visualized as small line segments). There is already at least one automated system known and disclosed within U.S. Pat. No. 6,397,120, No. 6,804,573, No. 6,836,695 and No. 6,947,808 that allows automatic conversion from graphical data (e.g. a scanned image bitmap) into embroidery design data. These patents disclose various aspects of image preparation, shape interpretation, and translation to specific embroidery data primitives based on a variety of factors. The methods described here can be used to preprocess and integrate the raw data supplied by an operating system to its printing subsystem such that it may be re-formed in a way that makes it appropriate or compatible as input to an automatic embroidery data generation system. More specifically, an overview of the systems methods disclosed here is presented in FIG. 1 and employs a low-level printer driver that forwards various types of printing commands to a variety of supporting software. Overall, allowing the user to convert artwork into embroidery designs by the simple act of printing that artwork (e.g., clicking a print button) may offer considerable advantage over other potential methods such as saving the artwork in specific formats or at specific resolutions for later importing by an automatic embroidery generation system. This contrast in use is one of several features that distinguish it from other methods.

The printer driver that facilitates the disclosed method may be configured as a raster printer that supports bezier curves and other forms of vector and bitmap data (e.g., vector outline representations of fonts, rectangles, ellipses, etc.). Configuration in this way, for example, tells the printer subsystem to send font glyphs instead of bitmaps and bezier curve points instead of normal straight line paths for outline data. This is useful in that it may provide greater accuracy in the image specification when compared to simple, fixed resolution bitmap information. Vector data is the term used to refer to graphical information where a region is specified by mathematically precise shape specifiers such as the edge contours that bound it. Often these boundaries are described as smooth curve or poly-line information. Alternatively, bitmap or raster data refers to more discrete data often in the form of pixels, where a region is specified as a function of what groups of pixels it contains. When the print driver is forced to process bitmap data (e.g., as a result of such data being forwarded from an application program), processing such as that described in previously mentioned prior art should be performed to convert that data to vector outline information. Once vector data is obtained, it is then the responsibility of the printer driver to further process it in order to make it suitable for embroidery design generation.

When a user prints a particular document (using the print facility supported by the computer's operating system), the printer subsystem calls various routines in a printer driver DLL (dynamic link library) with data to be printed. Example names of such routines may include DrvTextOut, DrvBitBlt, DrvFillPath, and DrvStrokeAndFillPath. These are some of the routines that are standardized as part of the Microsoft Windows operating system printing subsystem. The implementations of these driver routines, as developed in the preferred embodiment described here, convert this vector information into more basic data structures that specify regions such as polygons, rectangles and paths, and then store them as records in a dynamically sized memory block. The path structure may be composed of several sub paths, which are typically either straight line paths or bezier curve points. A path structure may be composed of multiple closed figures formed from several sub paths. The printer dll may also generate additional parts of a path required to close a figure by connecting the first and the last points in a path or sub-path structure.

The closed or open figures (i.e., shapes) resultant from path structures may be of two types—fill and stroke. A fill shape uses a path structure to delineate its outer most boundaries, whereas a stroke shape uses a path structure to delineate a continuous curve with a predetermined thickness and is typically not actually bounded by the path or sub-path. The printer subsystem specifies a number of attributes to be used to draw such shapes. For example, for fill shapes, the printer subsystem could specify the brush type and color while for stroke shapes it could specify pen color, pen width, end cap and join types. More examples on the type and variety of properties that may be specified for shapes at the printer driver level may be found within printer driver development documentation provided by Microsoft and other operating system vendors. This information is associated with the record of each individual shape. Some of the properties specified by the printer subsystem might not be able to be expressed directly as stitches because of the inherent limitations of embroidery. In such situations, the closest representation may be automatically chosen by default while the user may choose to modify it later-in or completely-after the embroidery generation process. For example, a pattern brush specified for a fill shape would be presented as a solid brush to the system with a default color where this shape will translate to a particular area of embroidery using the specified color as a thread color using a specified fill pattern to approximate the texture or nature of the pattern.

After the printer subsystem signals an end to the printing of a document (e.g., by calling the function DrvEndDoc) the printer dll transfers raw vector data to the Embroidery Generation Support Program (referred to hereafter as the EG method). Various methods can be used to transfer the data to the EG method such as saving it to a (temporary) file, passing individual messages for each record or utilizing a shared block of memory. In one embodiment, the printer dll passes a predetermined unique message to the EG method indicating that the raw vector data is available in a shared memory block.

Prior to passing the message, the printer dll copies the shape records and associated information in a predetermined order from the internal dynamic memory block to the shared memory block.

The EG method uses a Path Generator (PG) method to generate polygonal boundaries from generic curves/polylines and also for stroked paths (e.g., sequences of curves and line segments to be drawn using a GDI pen with particular attributes). Line attributes that are associated with pen types (e.g. pen width, pen color, etc.) may then be used to create a set of polygons that delineate an exterior edge boundary of a stroked path. In some cases, Microsoft Windows® GDI path functions may be called to generate polygons along a stroke path which are visually identical to the original line drawing path after filling occurs during rasterization. However, these functions are typically not sufficient for use here since their precision is often tied to a particular raster resolution.

The EG method then uses a Metafile Compositing (MC) method that sequentially takes shapes (e.g., polygons) where filling modes and color attributes are specified as input and then outputs a set of consistently formed non-overlapping maximally contiguous regions. Input polygons need not necessarily be regular polygons, i.e. polygon vertices may be specified in any order (clockwise or counter-clockwise) and the polygon itself may be self-overlapped. The output is order-specified, i.e. the outer most edge for each region is specified in a counter-clockwise order and any contours indicating holes are specified in a clockwise order. This constraint may not be required, but is often useful in simplifying many subsequent processing tasks including computation of intermediate data such as skeletons (e.g., Voronoi diagram computation), deformation of regions, etc. The EG method then analyzes the composite objects (i.e. the outputted regions) and generates stitch data which can then be fed to an embroidery machine for stitching. The actual methods used to generate stitch data are similar to those already disclosed in the previously mentioned prior art system. A more detailed description of the EG method and some related methods is now provided.

A stroked path typically has symmetrical properties. Specifically, all end-cap types are symmetrical along the path's center line; all types of joints are symmetrical along the joint angle bisectors. The PG method maintains visual features after adding the stroke outline points and maintains shared points between different connected segment paths consistently. Thus, paths generated by the PG method may be substantially more accurate and resolution independent than ones generated by built-in GDI functions.

The PG method invokes several methods to compute the end cap and joins based on the attributes specified at the print driver level.

Figure 14:
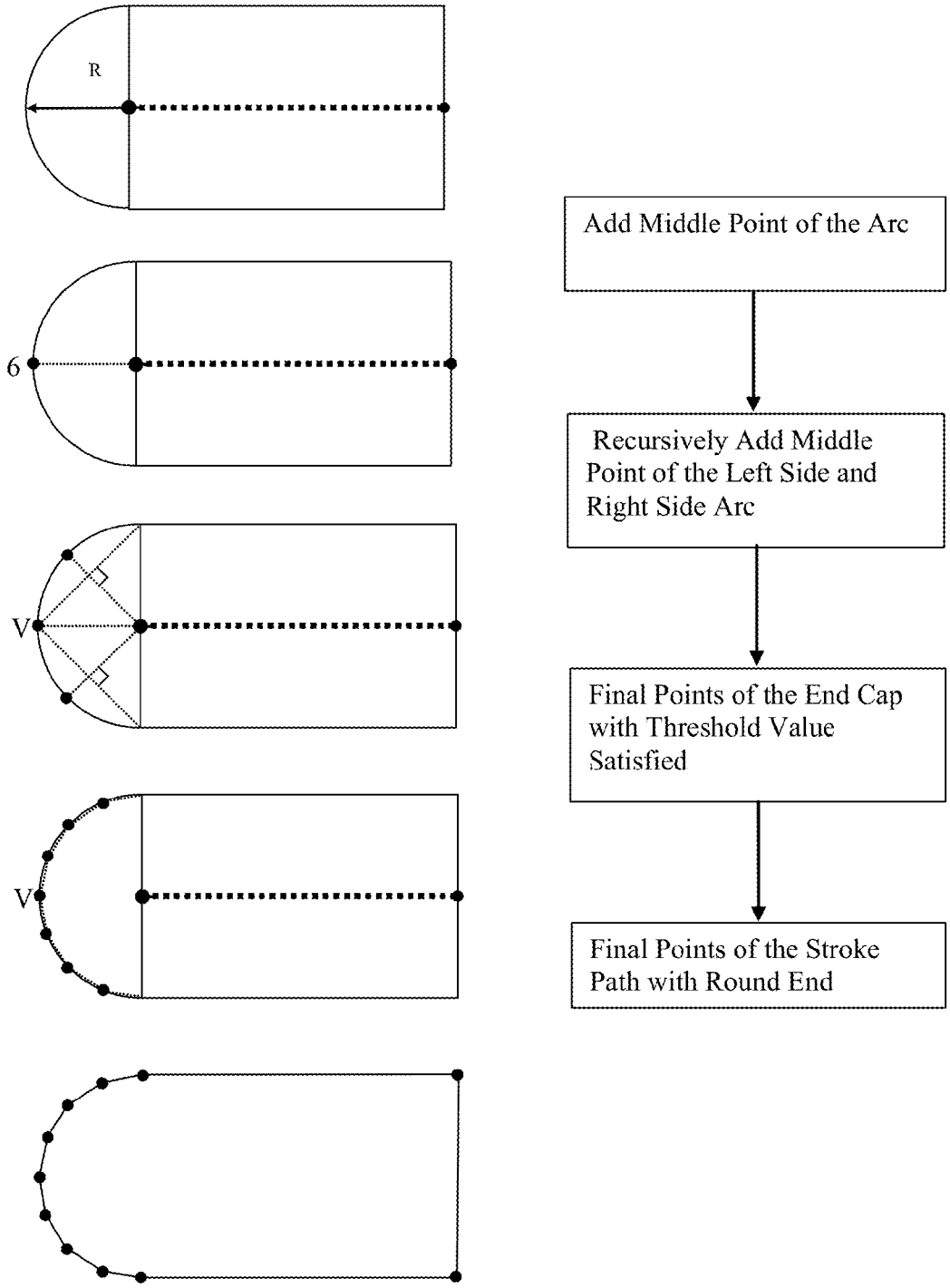
FIG. 14: Illustration of an example method to generate round end-cap stroke path outlines.

The Process Round End Cap (PREC) method is used to compute edge boundary vertices at the end point of a stroked path when the selected pen type indicates round end caps as one of its attributes. To maintain the symmetrical property of the round end-caps, the middle point of the arc (Refer to FIG. 14) is added first, then boundary edge vertices on left and right sides of the arc are added recursively until a minimum threshold value for smoothness of the arc is meet. Detailed operations of the process are illustrated in FIG. 14.

The PG method uses a Process Square End Cap (PSEC) method to compute edge boundary vertices at the end point of a stroked path when the associated pen type indicates squared end caps. Right corner points and left corner points are added first. Example operations are shown in FIG. 15.

Figure 16:
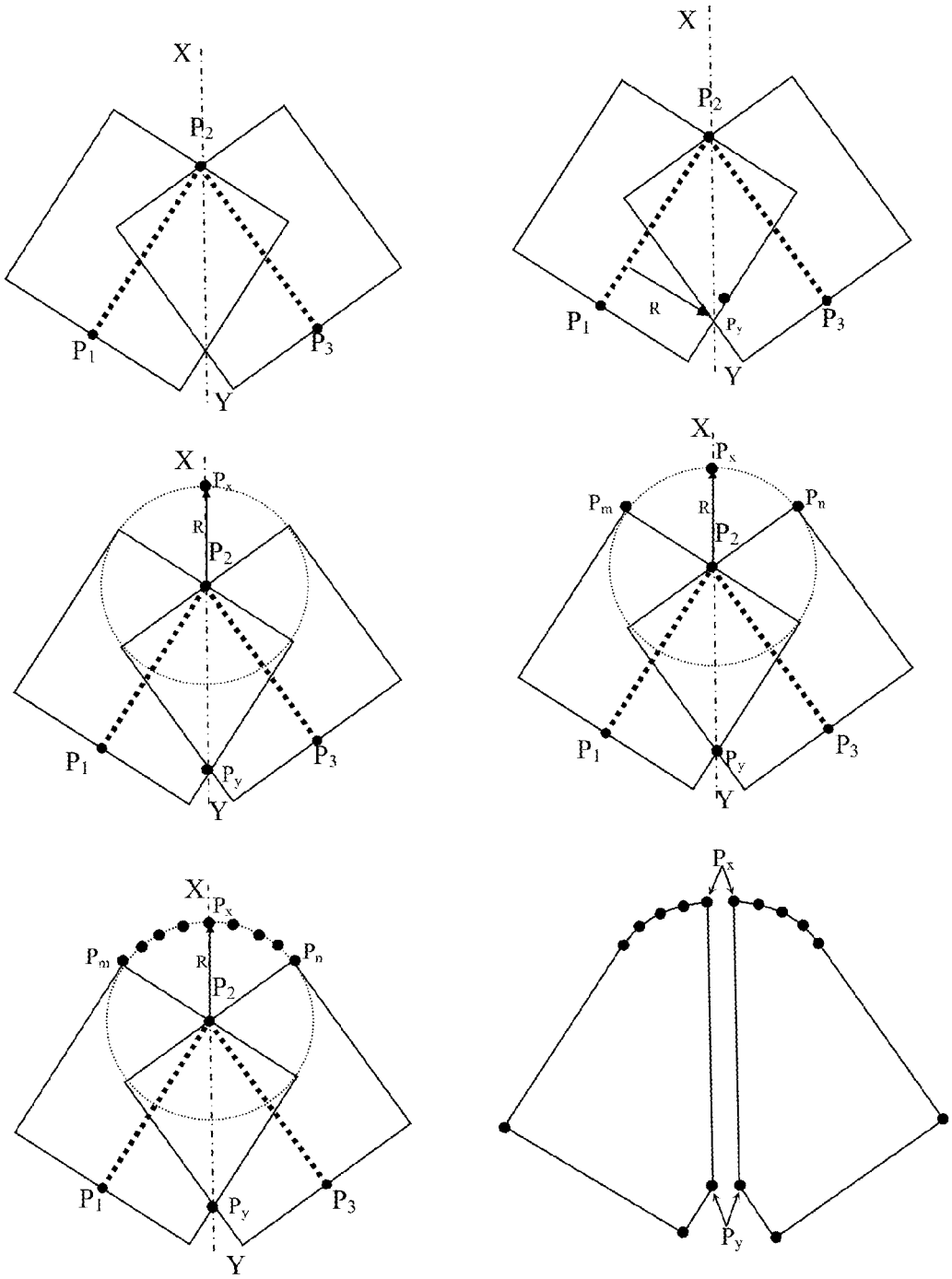
FIGS. 16 and 17: Example method to process round type joints.
Figure 17:
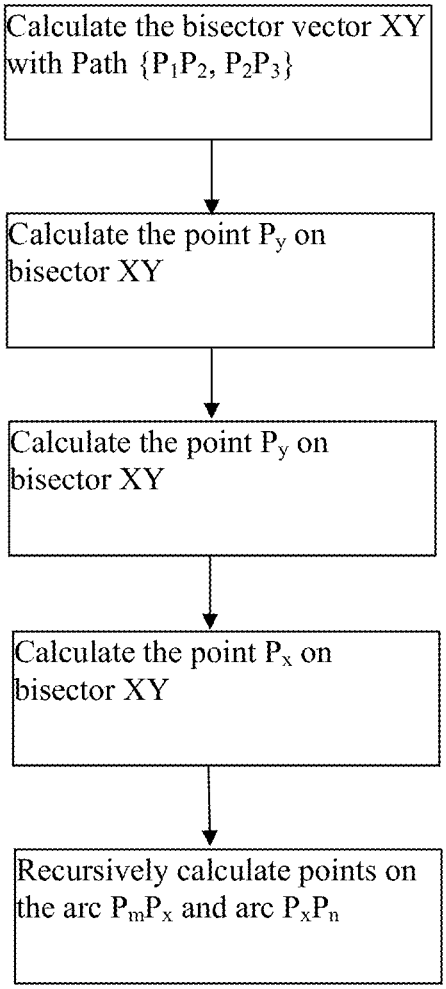

Process Round Join (PRJ) method is used to compute edge boundary vertices when the selected pen type indicates a round join type. First, the bisector of the two connected path segments is computed (see FIG. 16). For the convex side of the path, two vectors are projected from the common join point of the specified related medial path where each vector is projected a distance of one half the pen width and orthogonal to each of the related medial path line segments. The ends of these vectors indicate the end points of the curved boundary to be computed on the outer convex edge side of the path. Then the endpoint of a bisector of these two vectors (again projected a distance of one half the specified pen width) is inserted into the boundaries vertex list. The rest of the vertices are then computed by recursively introducing new bisectors as specified in FIG. 17 and illustrated in FIG. 16.

Figure 18:
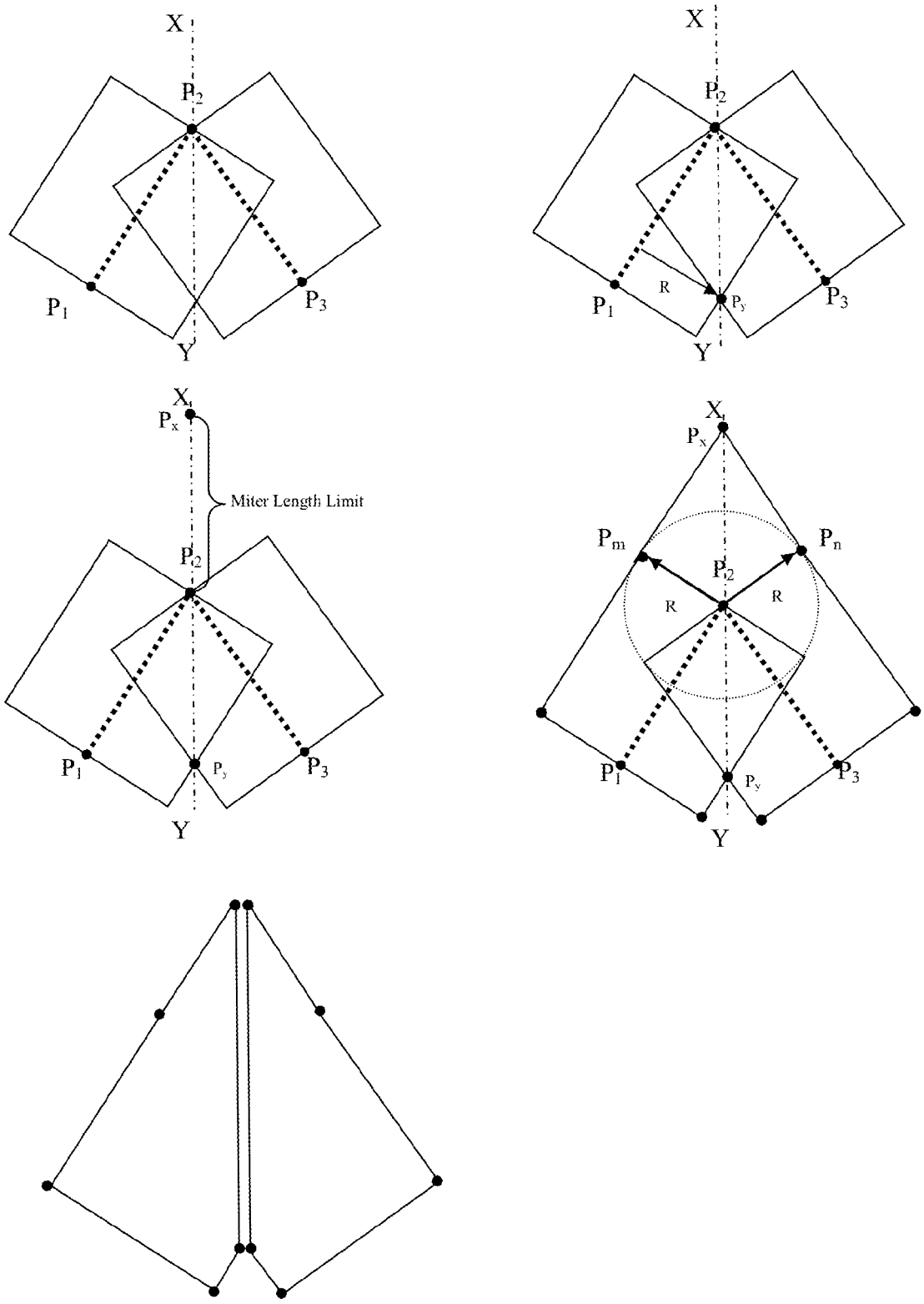
FIGS. 18 and 19: Example method to process miter type joints.
Figure 19:
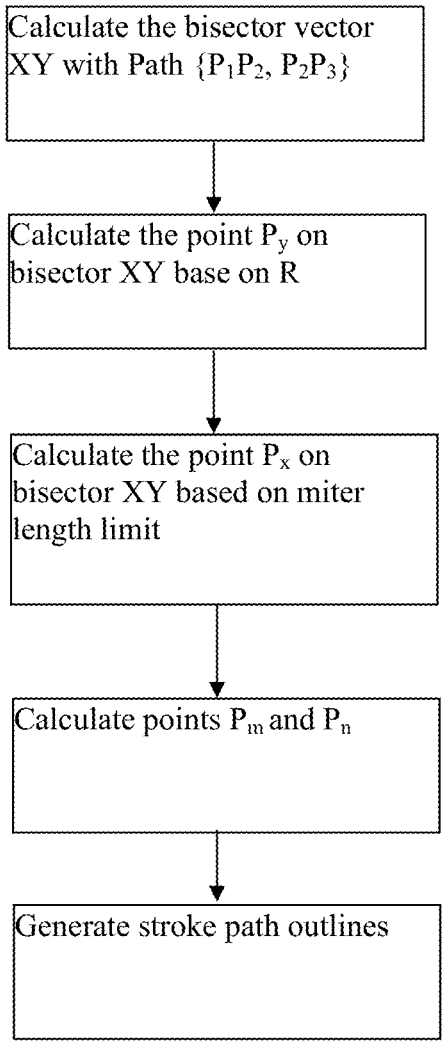

Process Miter Join (PMJ) method is used to compute edge boundary vertices when the selected pen type indicates a miter join type. Here the bisector of the two connected path segments is computed (see FIG. 18). Point $P_y$ on the concave side (see FIG. 18) is computed on the bisector based on the path radiation R (i.e., based on one half the specified pen width). Point $P_x$ on the convex side is computed based on the miter limit length. If the limit is not set with the associated pen property, then $P_x$ is computed using the extensions of two side boundaries (see FIG. 18).

Figure 20:
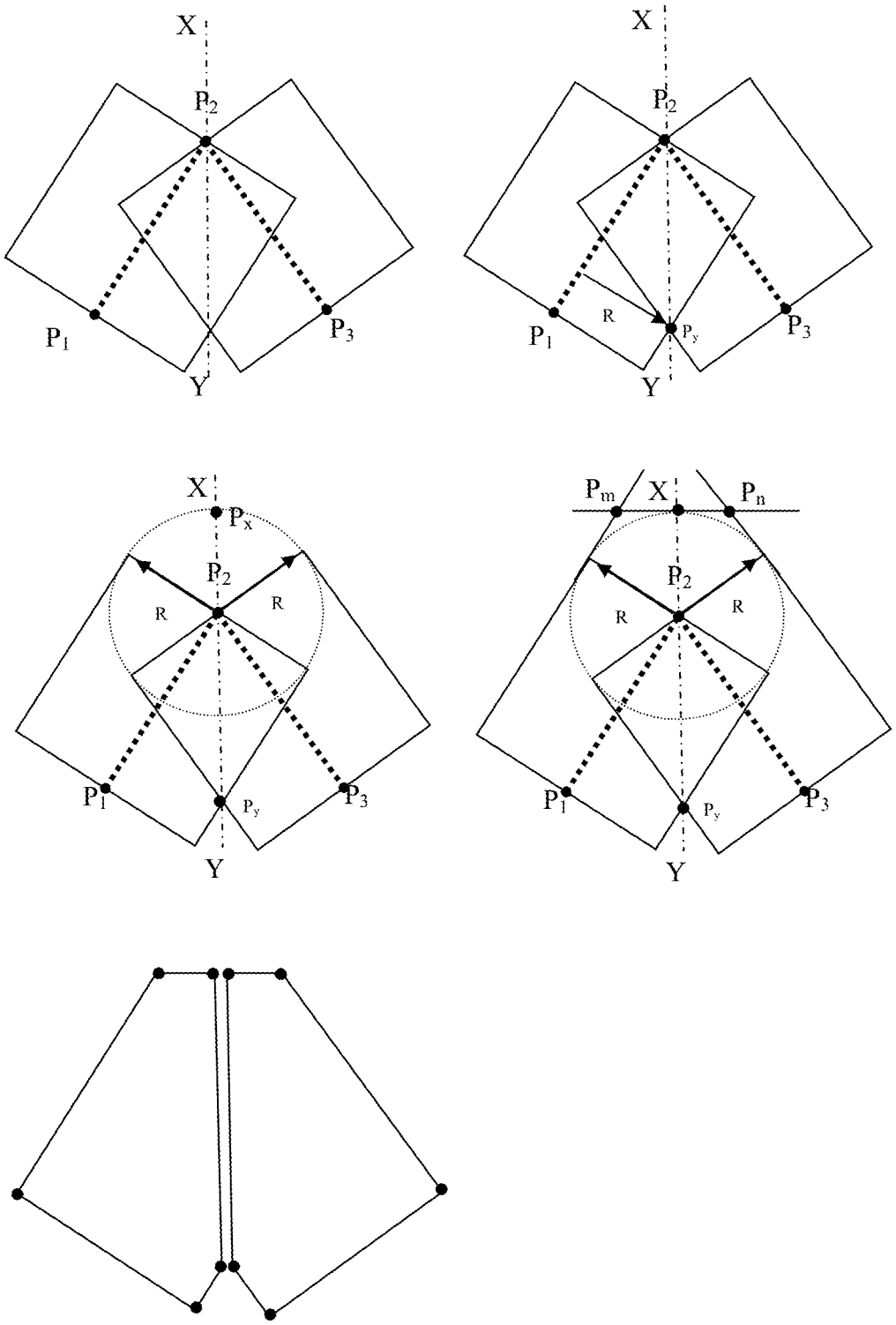
FIGS. 20 and 21: Example method to process bevel type joints.
Figure 21:
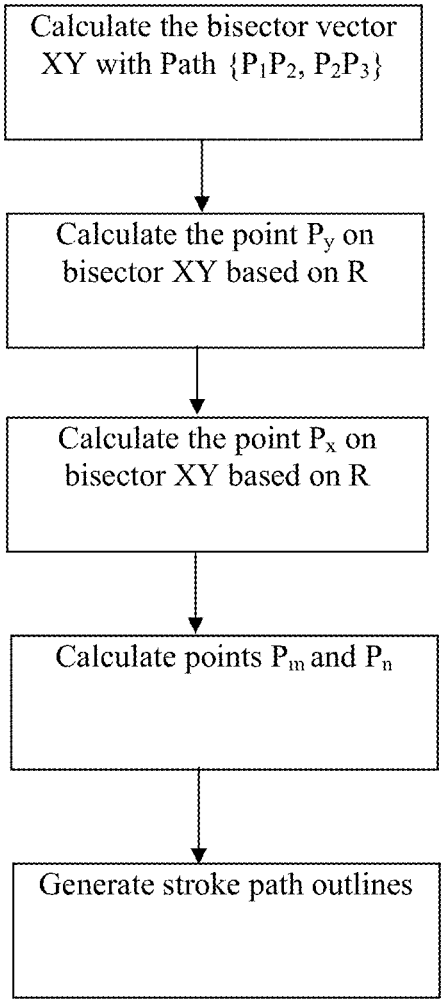

Process Bevel Join (PBJ) method is used to compute edge boundary vertices when the selected pen type indicates a bevel join type. The bisector of the two connected path segments is computed (see FIG. 20). Point $P_y$ is computed similar to the methods used within the PMJ method. Point $P_x$ is calculated on the bisector based on the pen width. Line $P_mP_n$ is calculated perpendicular to the bisector line and Point $P_m$ and $P_n$ are the intersections with two side boundaries which are parallel to the related path segment. A final boundary shape is illustrated in FIG. 20. The MC method (also referred to as the compositing method) receives the printing records and translates them into a set of closed contours that delineate the contiguous regions equivalent to those that would result from rendering (e.g., printing) the original file on an arbitrarily sized display. These printing records may be thought of as analogous to a computer graphics metafile (CGM) specification in that they are an ordered list of commands that may be used to reproduce a visual picture or image. The ISO specification is a four-part standard defining a file format for the application-independent capture, storage and transfer of graphical pictures. Compositing computer graphics metafiles (CGM) is the process of applying various Boolean operators among potentially overlapped primitive shapes specified within a file designed to create a visual image. On a raster-type device such as a computer's CRT display or inkjet printer when a subset of vector commands overlaps or otherwise intersects with previously drawn or executed commands, the pixels within the overlapped areas are simply reset to the color specified by the more recent vector commands. Thus, potential redundancies within a metafile (i.e. situations where multiple commands repeatedly "paint" within the same area) are resolved through a process of rasterization in which more recent commands always take precedence over those that were previously executed. However, for many applications, the loss of flexibility that results from rasterization (e.g., loss of detailed outline information) makes it less suitable for developing a usable composite representation of a metafile's vector commands. Specifically, it may be desirable to eliminate redundancies within vector outlines by actually modifying the underlying outlines directly so that painting within any given area never occurs more than once (i.e., no overlapping occurs). This may provide such benefits as greater compression of picture information. Also, the result may be used for other applications such as computerized embroidery imprinting in which it is often undesirable to repeatedly sew or place stitches within a single area of fabric. Note that compositing is not a strict requirement of the print driver method disclosed here. Without compositing, embroidery data may still be generated separately for each of the individual underlying print records. However, there are many situations where such an approach yields embroidery data that may not be practical for actual production on embroidery equipment (e.g., sewing repeatedly over the same area or triggering excessive thread trims or redundant needle movements even when sewing a single same-colored contiguous area). Hence, compositing is included here as a desirable step to achieve a more consistent usable result for embroidery data generation.

The compositing method is comprised of four general operations: 1) Finding intersections among the edges of regions (e.g., polygonal boundary intersection). 2) Finding segment fill pairs. 3) Arranging segments and 4) Re-establishing segment lists and the resultant associated output regions.

The MC method first executes a Find Polygonal Object Boundary Intersection (FPOBI) method which permits the reliable and predictable detection of intersecting polygonal edges. This method makes use of the line sweep technique and algebraic predicates, but has also been further extended to handle additional requirements and degeneracies precipitated by the compositing operations. Some of the degeneracies have been tackled individually in previous work, but still do not facilitate a comprehensive and robust solution to the specific issues discussed here. Previous work includes a method for testing two simple polygonal objects using enveloping triangulations. Another method includes heuristics for detecting whether two polygons intersect using a grid-based method, a method that works optimally when the polygon edges are distributed in a uniform manner (which would not be typical of input cases dealt with here). This method offers some distinct benefits when compared to basic line-segment intersection algorithms. Numerous methods have been presented that solve the problem of finding intersections among line-segments. Unfortunately, it has also been shown that several prior art methods largely rely upon models of exact computation that may become computationally impractical for engineering solutions implemented using hardware which supports only IEEE floating point representations. One previous method proposed the plane-sweep algorithm for finding intersections among line-segments which solves the problem in time $O((n+k)\log n)$. This method also has been reported to be quite sensitive to numerical errors and, hence, must also rely upon a model of exact computation to produce correct results. Thus, one proposed solution relies upon algebraic predicates to alleviate many of the numerical issues prevalent in the line sweep algorithm and argue that this algorithm may be superior to others since it requires a comparatively lower degree predicate than that which would be required by other algorithms.

The MC method is different from Polygon Clipping or other operators that compute Boolean operations among specified regions. Algorithms that facilitate a Boolean set of operations that may be used to unite, subtract, or intersect solid objects with each other is a common component of many solid modeling systems. Polygon Boolean operations are derived from polygon clipping algorithms. Many polygon clipping algorithms have significant limitations, (e.g., some algorithms are limited to convex polygons, some algorithms require that the clip polygon be rectangular; some algorithms do not allow polygon self-intersections). Commonly encountered CGMs (computer graphics metafiles) cannot be easily modified to adhere to such restrictions (including those produced by the print driver method described here). Even the simple case of detecting if one polygon lies within the boundaries of another polygon becomes less obvious when one of the input polygons intersects with itself (a degeneracy that is common within metafile records). Vatti's algorithm and Greiner and Hormann's algorithm can be used for testing polygon self-overlaps by counting the winding number. However, overlaps that result in zero-area portions of the polygon would still not be eliminated as is inherently required by the problem presented here. Many efficient polygon clipping algorithms have been published in the literature, however, a direct substitution of such algorithms to handle the task of metafile compositing is generally infeasible. Hence, the metafile compositing method described here is largely focused on developing Boolean operators suitable for input sets with large numbers of polygonal objects containing varied degeneracies, to provide a fast, robust, comprehensive and practical solution.

The MC method is related to the problem of map overlay studied within computational geometry. Solutions to this problem involve detecting and subsequently processing the intersections and unions of polygonal objects that are placed within a two-dimensional space (e.g., outlines of highways, rivers, lakes, etc.). Thus, if each vector command within a graphics metafile is considered as a layer in a geometric map, the techniques used in map overlay may be applied to the problem of metafile compositing. The input of a map overlay operation consists of two or more topologically structured layers and the output is a new layer in which the new areas in that layer are given attributes that are based on the input layers. The procedures are similar in that an overlay operation takes two or more data layers as input and results in an output layer, just as a metafile contains many records and the output may be considered as a single layer. However, there are several differences. First, the ordering of input records or layers within metafile compositing is important; if the input order is changed, the output may be different. Thus, when applying map overlay algorithms to metafile compositing, the time sequential features of the metafile records are taken into account. Second, in map overlay algorithms, different layers have different attributes. However, in metafile compositing, different records may have identical attributes, for example, the same color. Therefore, in certain situations, merging operations may be performed for same attribute layers when constructing the output. Finally, in map overlay one region may receive attributes from many layers; in compositing CGM, any given region typically only receives attributes from a single record.

CGM command records (e.g., the printing records) may contain degenerate polygonal objects, such as zero-length segments, zero-area polygonal objects, grazing and self-overlapping. Many records may also be drawn in the same region redundantly. The vertex list order is not specified. The closed area is the brush painting area, thus, some records may be drawn in clockwise order while others are drawn in counter-clockwise order. CGM records may be attribute filled using different modes (e.g., alternate edge/scanline versus winding rule fills). Filling modes must be considered to generate correct results.

CGM input records paint arbitrary, potentially overlapping regions sequentially where the ordering of records combined with their fill attributes is important. For example, for records with different fill colors, the newly drawn record hides the previously drawn record if they are overlapping or partially overlapping. Based on this property, the Boolean operation of "NOT" is performed if two input records have different colors and the newly drawn record has a higher drawing priority (e.g., is present later within the list of input records).

Overlapping records that have identical fill attributes (e.g., same color) in certain instances may be processed to eliminate the extra overlapping portion since this does not affect the visual appearance of the metafile. Thus, in these instances, a merging or logical "OR" operation may be performed.

Other prior art methods such as graph exploration for overlaying planar subdivisions do not address issues of numerical accuracy or degeneracy within input data sets. Unfortunately, without consideration of such issues, a practical and robust solution is difficult to obtain. Examples of such degeneracies include zero-length segments, zero-area polygonal objects, grazing, self-overlapping, and multiple congruent polygonal region boundaries. The MC method disclosed here has been shown to work for very large numbers of polygons where such input data may contain large numbers of degeneracies of the types mentioned previously. The method considers not only the original geometric coordinates, but also the original drawing sequence and filling modes. Output display is visually identical to the input, the difference being that all overlap of dissimilar attributes and all adjacency of like attributes are removed. The method's performance within the presence of degeneracies and large input sets is one feature which distinguishes it from previously published related work.

In order to disclose the details of the MC method some basic definitions are first provided. The terms defined may relate to terminology used here as well as in prior art that may discuss other methods that employ sweep-line approaches to solve problems within computational geometry. First, an "event point" is defined as a point in the plane at which the sweep algorithm evaluates and processes current input and data structures. Event points are ordered according to their y and then x coordinate values. In the MC method event points are the endpoints of line segments or computed intersection points between two or more line segments where these line segments represent the outer boundaries of polygonal regions. An "edge" refers to the connection between two event points (i.e., its end points). Its domain is a finite, non-self-intersecting open curve. An edge has two end-points and its length is greater than zero. $E[A_iA_j]$ denotes an edge that has $A_i$ and $A_j$ as its end-points. A "segment" is similar to an edge in that it is also a closed line. It stores an upper-end-point and a lower-end-point. Let $S[A_iA_j]$ denote a segment that has $A_i$ and $A_j$ as its end-points. Let $A_i<_yA_j$ denote that point $A_i$ is smaller than $A_j$ along the y-axis. Similarly, $A_i<_xA_j$ denotes that point $A_i$ is smaller than $A_j$ along the x-axis. If $A_i<_yA_j$, or $A_i=_yA_j$ and $A_i<_xA_j$, in the printer device coordinate scheme, $A_i$ is the upper-end-point and $A_j$ is the lower-end-point. A "segment pair" consists of two segments which intersect the sweep line and lie on opposite edges of a given region. It indicates an area between two segments that is part of a GDI fill area for a particular metafile record or polygonal object. A "segment pool" contains segments having a particular attribute (e.g., color) as inherited from the original input data (i.e., the attribute of its related polygonal object). Multiple segment pools are maintained within the MC method where there is one and only one pool for every attribute present within the input data. A segment pool invariant is that while segments may share end points, no segment within a given pool may be coincident with any other segment within that pool. Note: segments may be added to a particular attributed pool, even though originally they may not have exhibited that attribute. However, once added to the pool they then lose their previous attribute and inherit that of the pool. A half opened edge, which only includes the origin point, is called a "half-edge." $E[V_iV_j]$ denotes a Half-edge that has vertex $V_i$ as its origin and vertex $V_j$ as its destination. If one walks along a main-half-edge, the face of an associated region lies to the left. For a twin-half-edge, the face of an associated region lies to the right. A closed polygon P is described by the ordered set of its vertices $V_0, V_1, V_2, \ldots, V_n, V_0=V_{n+1}$, where n>=3. It contains all main and twin half-edges consecutively connecting the vertices $V_i$, i.e. the main half-edges are $E[V_0V_1)$, $E[V_1V_2)$, $E[V_{n-1}V_n)$, $E[V_nV_{n+1})=E[V_nV_0)$ and the twin half-edges are $E[V_nV_{n-1})$, $E[V_{n-1}V_{n-2})$, . . . $E[V_1V_0)$, $E[V_0V_{-1})=E[V_0V_n)$. A "polygonal object" O is described by a set of polygons $P_0, P_1, P_2, \ldots, P_n$ where $P_0$ is the outer polygon, which is specified in a counter-clockwise order and $P_1, P_2, \ldots, P_n$ are inside $P_0$ and are specified in clockwise order. In terms of metafile compositing, a polygonal object is a distinct, named set of attributes that represents a contiguous graphic region. The attributes hold data describing the graphic, such as color, drawing sequence, etc.

Let S be the set of segments of all polygonal objects in the plane. Let Q be the sorted vertices of segments (sorted by y and then x values) in the plane; these points will be evaluated as "event points" within the algorithm. Let $\tau$ be the sorted list that stores those segments that intersect with a sweep line. P is the pointer that indicates the current event point being evaluated within Q. Let U(P) be the set of segments which have P as their upper endpoint. Let L(P) be the subset of T which has P as its lower endpoint. Let C(P) be the subset of $\tau$ which has P as its interior point, meaning P is on that segment but is not the endpoint. $S_l(P)$ and $S_r(P)$ denote, respectively, the left and right neighbor segments of P in $\tau$. Let A be the collection of segments in $\tau$ (the status tree). Let $M_l(A)$ be the left-most segment of A and $M_r(A)$ be the right most segment of A. Note, lines of pseudo-code shown in FIG. 25 represent an overview of the method used to find boundary intersections. Lines printed in bold, represent modifications over that which was presented in previous methods.

There are many differences between the sweep-line methods disclosed here when compared to other commonly-known sweep line algorithms. Other published algorithms do not address details on the treatment of special cases and degeneracies or, when present, such details are only partially explained. For example, some methods assume any two segments or curves will intersect at most at a single point which may not be true. Here, an attempt is made to avoid such assumptions and fully consider the details of degenaricies to allow a comprehensive engineering solution.

A predicate arithmetic model is used to determine if two segments intersect in line 1 of FindNewEvent (see FIG. 25), an approximation of this intersection point is also computed and stored. Using algebraic predicates, the determination of whether two segments intersect is guaranteed to be correct as long as input data coordinates do not exceed what may be represented by 24-bit integers. In this specific application, input coordinates of metafile records are stored as 16-bit integers. However, the construction and storage of actual resultant intersection points does not have the same guarantee of accuracy and inevitably some rounding of results may occur potentially shifting the locations of intersection points from their true positions. Such rounding may potentially impact the final output in that certain polygonal vertices may be inaccurate to the extent that IEEE floating point arithmetic results yield slightly different values for their positions. However, particular care is taken such that this rounding will not prevent the method from constructing its output. This is primarily achieved by assuring some degree of consistency in the rounding that will occur and allowing the algorithm to effectively ignore such rounding. For example, when two segments intersect, where one or both of those segments emanate from previously computed intersections at one or more of their end points, the original end points of the related segment (rather than the "intersection end points") are used for both detection and construction of an intersection point.

Figure 26:
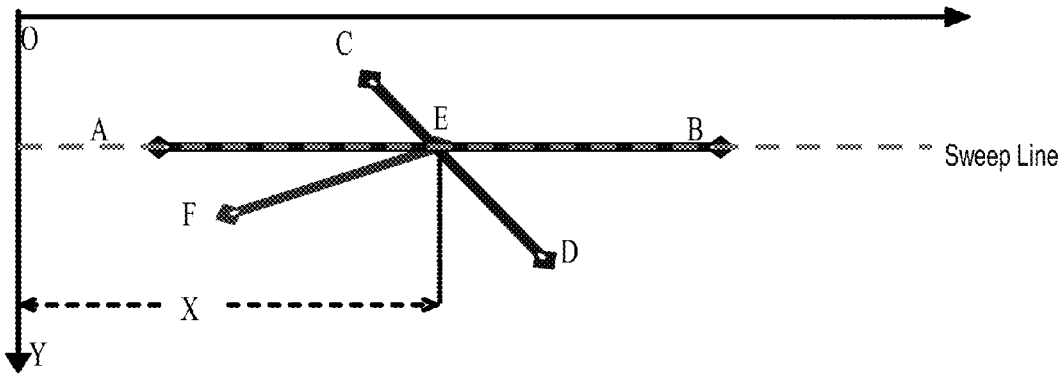
FIG. 26: Sorted Segments inside Status Tree. There are three segments in this figure; they are: [AB], [EF] and [CD]. At event point E, the order of the segments in the status tree is: [EF], [CD], [AB], in sequence.
Figure 27:
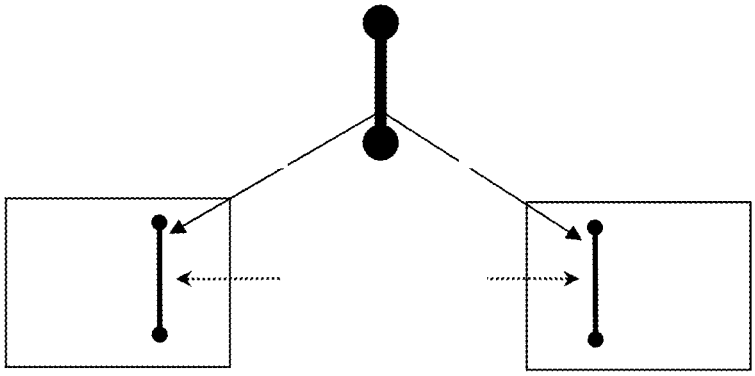
FIG. 27: Example of Twin Segment
Figure 28:
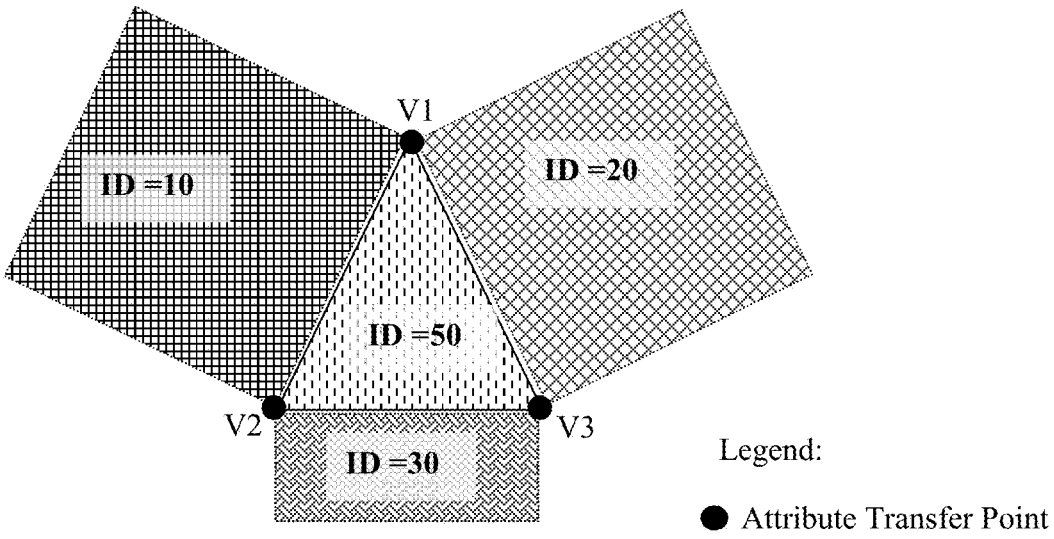
FIG. 28: Example of border information. In this situation, edge border information for object 50 is: edge V1V2 border ID is 10, V2V3 border ID is 30, and V3V1 border ID is 20.

It has been suggested that the order of the segments in the status-tree corresponds to the order in which they are intersected by the sweep line just below the related event point. However, this appears to be insufficient in some cases (see example in FIG. 26). According this method, the key value for [AB] cannot be found, because an intersection point below the sweep line is not present. Here, in such cases, a super-key may be used to sort the segments in the status-tree: the first attribute of the super-key is the x-coordinate of the point intersected by the sweep line and the segment at the event point; the second attribute of the super-key is the segment's slope.

An intersection is a point where lines intersect by definition. This definition is used by most previously published work. However, for polygonal object intersection, this is not always applicable. If two segments from the same polygonal object intersect at both end points, this intersection may not be considered as an intersection of the object. Only intersections of segments that are from different polygonal objects should be reported. In lines 6, 17, 19 and 22 of HandleEventPoint and line 5 of FindNewEvent, segment classification is performed before reporting intersections. Typical CGM records cannot be assumed to be simple polygons. Rather, they tend to exhibit all types of deficiencies, such as self-intersections and grazing contact between multiple polygons (e.g. holes) even within a single polygonal object. The above algorithm can be modified slightly for detecting and finding self-overlapping intersections.

These compositing methods presented here are intended to eliminate redundant segments and re-establish link-listed polygonal objects. This is accomplished primarily through the creation and use of segment pools where segments having a particular shared attribute are organized together in a single pool. As the sweep-line process progresses, each segment (through its association with a segment pair) may either be discarded or moved to one or two segment pools. Another invariant of the sweep-line process regarding segment pools is that while segments may share end points, no segment within a given pool may be coincident with any other segment within that pool and no two segments will cross each other. Preservation of this invariant is largely addressed within the Overlapped Segments Selection Criteria algorithm summarized in FIG. 24. For example, lines 2 and 3 of the algorithm imply that $S_m$ or $S_n$ may be selected into different segment pools with different attributes or neither may be selected. Similarly, the duplication rule cannot generate coincident or duplicated segments to an individual segment pool. After this sweep completes, a segment pool has the property that traversing segments within the pool (via another sweep pattern) generates one or more cycles (i.e., closed contours containing no self-crossings).

Segment pairs (see definitions disclosed earlier in this specification) are found at each event-point (event-points include original segment end points and segment intersections) based on CGM filling rules. These pairs are intended to indicate areas between each pair that comprise filled portions of related polygonal objects. Finding segment pairs is a preprocessing step for segment arrangement (e.g. selection and duplication to segment pools) that effectively eliminates unneeded or redundant segments of a polygon (i.e. segments that have been occluded due to filling rules or self overlap). Similar to the algorithm used for finding intersections, it is assumed that a scan-line goes from top to bottom, halting at each event point. Segment pairs are easily located if the original related print or metafile record uses an alternate edge fill mode. More specifically, it can be done by just selecting the odd and even segments on the scan-line and pairing them up respectively. If a record and its related polygonal specification use a winding-rule fill mode, the original drawing direction must be stored and the fill depth must also be tracked. FIG. 22 depicts the algorithm used here for finding segment pairs when a winding-rule fill mode is specified.

Figure 6:
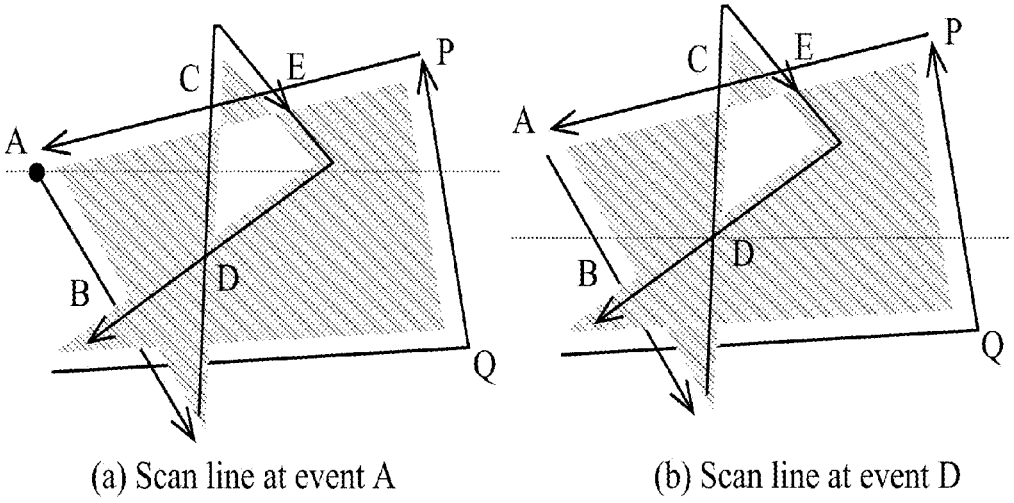
FIG. 6: Segment Pairs using winding rule fill mode illustrated. A is the starting drawing point. Segment pairs are {ABleft, CDright} and {EFleft, PQright} at event point A in (a). Segment pair is {ABleft, PQright} at event point D in (b).

Segment pairs may change at each event point. For example, at event point A in FIG. 6(*a*), segment pairs are $\{AB_{left}, CD_{right}\}$ and $\{EF_{left}, PQ_{right}\}$. While at event point D in FIG. 6(*b*), segment pairs are $\{AB_{left}, PQ_{right}\}$ (i.e. the pair segment AB changes at different event points due to the winding rule fill mode).

Figure 7:
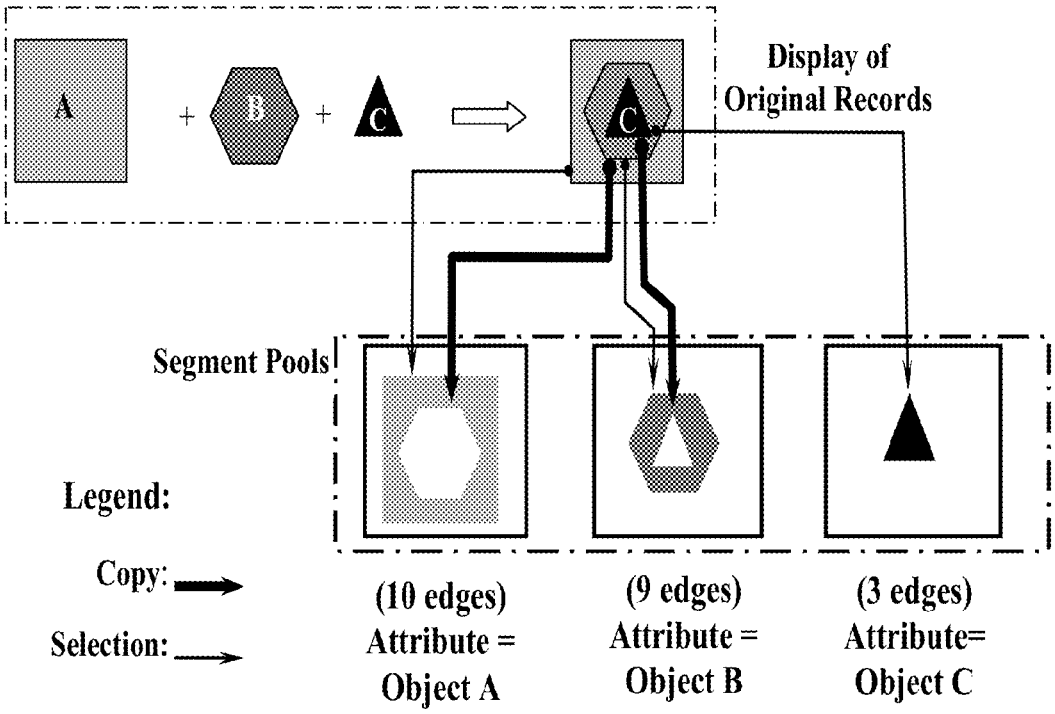
FIG. 7: Segment Selection and Duplication

The Segment Arrangement (SA) method described here determines at each "event point" whether an input segment should be eliminated, selected or duplicated based on metafile drawing and filling rules. Elimination means a segment that is drawn underneath other primitives will not be put into any segment pool. Selection means an original segment will be moved into a segment pool with similar attributes. Duplication means an original segment is copied into a segment pool with different attributes (where the copied segment then assumes the attributes of the pool into which it was copied). These three rules, shown in detail below constitute guidelines for the final arrangement algorithms. In general, segment selection and duplication are based on two factors: attribute values and age of the related polygonal object. A polygonal object is said to be younger if it appeared sequentially later within the list of metafile records. If a polygonal object is created earlier, it is considered older. For example, for differently colored objects, segments that are from younger objects may be selected and duplicated for those objects that are underneath or overlapped by them. These can be observed, in FIG. 7, where object C is specified last and its segments will be selected and copied for object B.

Rules for Segment Elimination, Selection and Duplication are described as follows: Let $S_{face}(i)$ denote the face that is associated with segment S belonging to polygonal object i, where polygonal objects are ordered by their age. Note if $j<i$ this indicates that the $i^{th}$ object is younger than the $j^{th}$ object. $\{SL_i, SR_i\}$ denotes a segment pair where $SL_i$ denotes the left segment (of the pair) of the $i^{th}$ polygonal object at a specific event point and $SR_i$ denotes the right segment. According to the CGM filling method, the following selection and duplication rules are defined in order to separate the segments according to their attributes:

The "Elimination Rule" is defined as follows: if $S_j$ is between any segment pair $\{SL_i, SR_i\}$, $S_j$ will be hidden in either of the following two cases: Case 1: $j<i$ or Case 2: $\text{Attributes}(S_{face}(i))=\text{Attributes}(S_{face}(j))$. If $S_j$ is hidden, it will not be placed or duplicated into a segment pool.

The "Selection Rule" is defined as follows: $S_j$ will be moved to a segment pool in either of the following two cases: Case 1: $S_j$ is not inside or between any segment pair $\{SL_i, SR_i\}$, or Case 2: Of all segment pairs that $S_j$ lies between, let $\{SL_i, SR_i\}$ denote the youngest pair. If $j>i$ and $\text{Attributes}(S_{face}(i))\neq\text{Attributes}(S_{face}(j))$ $S_j$ will be moved.

The "Duplication Rule" is defined as follows: Of all segment pairs that Sj lies between, let $\{SL_i, SR_i\}$ denote the youngest pair. If $j>i$ and $\text{Attributes}(\text{Sface}(i))\neq\text{Attributes}(\text{Sface}(j))$, let $S_j'$ be the duplication of $S_j$ where Attributes (S'face(i)) are assigned Attributes(Sface(i)) and $S_j'$ is placed into the associated segment pool.

To further the operations of segment arrangement, an object stack is used to store active polygonal objects, where an object is considered to be active while scan lines continue to intersect with it. When the scan line hits the left segment of a segment pair, the object that is associated with that left segment is pushed on to the stack. Similarly, when the scan ray hits the right segment of a segment pair, the object associated with the right segment is popped off the stack.

Assuming a ray comes from infinity on the left and moves toward infinity on the right. Let $S^k$ denote a segment that intersects with the ray, where k=0, 1, . . . , n. At each event point, all segments are sorted from left to right (using the same method used previously for finding intersections) and stored in a queue. Therefore, $S^0$ is the left most segment, and $S^n$ is the right most segment.

It is not safe to assume that $S^0$ through $S^n$ do not overlap. It may be commonly found that many segments are coincident (i.e., share the same two end points). Such cases require additional bookkeeping and are discussed next. FIG. 23 delineates the general elimination, selection and duplication algorithm.

Lines 1 and 4 in FIG. 23 must be modified when several segments are coincident, because otherwise any one of these coincident segments could be arbitrarily or unpredictably hit first by the scan ray. In such cases, coincident segments are reordered and grouped into a "right group" and a "left group" where each group is then sorted. Specifically, Let S be the coincident segments which intersect with the scan ray. Let $S_{left}$ be the segments in S that belong to the left group (i.e. segments that are marked as the left segment within their corresponding segment pairs) and similarly, let $S_{right}$ be the remaining segments in S that are marked as right segments. $S_{left}$ and $S_{right}$ are then sorted by their related polygonal object's age (ascending order, youngest first). Let $S_m$ and $S_n$, denote the youngest segments within $S_{left}$ and $S_{right}$ respectively. Ø denotes an empty segment set. Thus, the modified segment arrangement criteria for the situation of multiple coincident segments are refined in FIG. 24.

Figure 8:
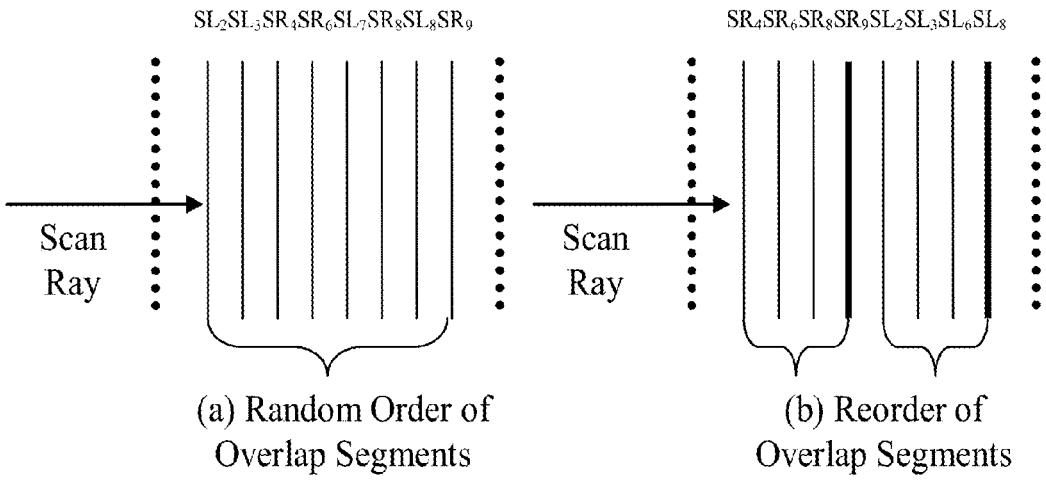
FIG. 8: Re-order of Coincident Segments Hit by Scan Ray (i.e. segments have identical end points).
Figure 9:
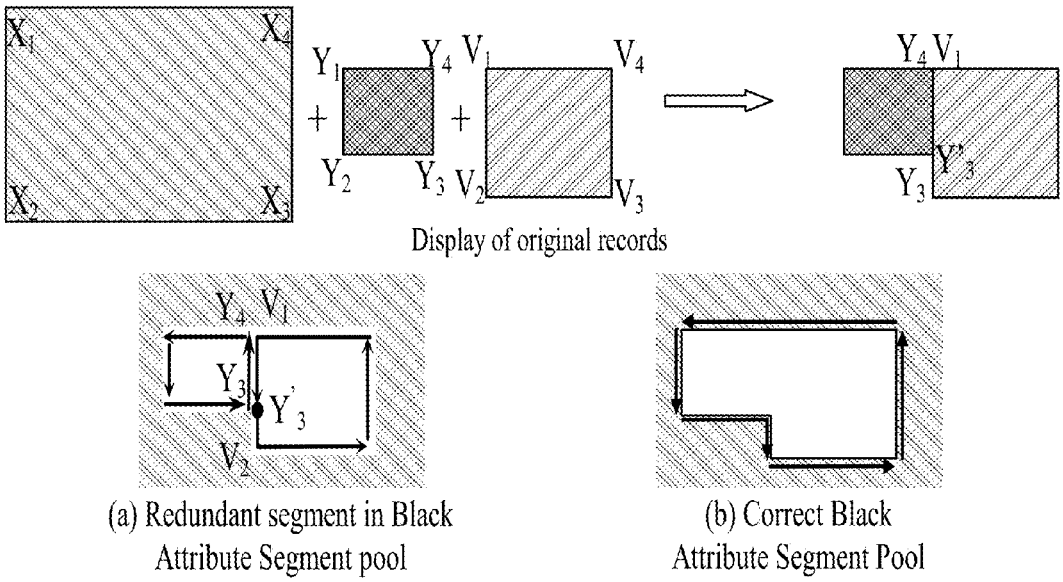
FIG. 9: Part (a) shows coincident segments in a Segment Pool and the incorrect hole that may potentially be generated. Part (b) shows the correct result with no coincident/redundant segments.

Note that in this special case, "Not Selected" implies "elimination", therefore, the elimination criterion is omitted altogether. Additionally, according to these new coincident segment selection and duplication rules, $S_{right}$ will be processed first then $S_{left}$. In the case of duplication, if there is at least one left segment and one right segment overlapping, even if they are not a segment pair, they will not be used for duplication. For selection, only the youngest left segment and youngest right segment will be selected. An example is illustrated in FIG. 8. Let $SR_2SL_3SR_4SR_6SL_7SR_8SL_8SR_9$ in FIG. 8(*a*) be overlapping segments where their order represents their intersection sequence with the scan ray. In this case, only $SR_9$ and $SL_8$ will be selected if the related face attributes of $SR_9$ and $SL_8$ are different. However, if the attributes of $SR_9$ and $SL_8$ are identical, neither $SR_9$ nor $SL_8$ will be selected or copied.

After segment pools are populated, a Generate Composite Objects (GCO) method must execute to generate new resultant objects that represent the final composite shapes within the image. This method effectively builds new objects using the segments contained within each pool. As a segment pool may contain segments inherited from initially unrelated or differently attributed polygonal objects, there is no inherent linking or sequencing among them (other than obviously being placed within the same pool). Thus, a final step is to reconstruct a consistent and uniform traversal of such segments to indicate the boundaries of the one or more polygonal objects contained in a pool (i.e. so objects are comprised of an outer edge contour specified in counter clockwise vertex order and zero or more inner edge contours, indicating holes, specified in clockwise order). This is accomplished most efficiently by performing one final sweep-line process (using the rules below) on each pool to construct the appropriate contours as just described.

Figure 10:
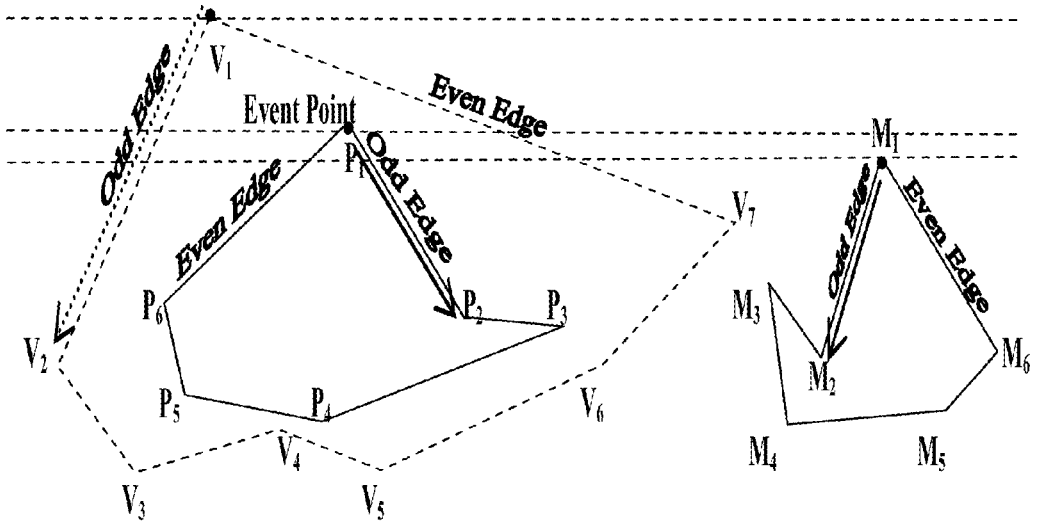
FIG. 10: $V_1$ is the first event point in this example. After traversal at $V_1$, edges in dashed lines are visited edges. At event point $P_1$, Edge $P_1P_2$ is the start traversal edge. $P_1P_6$ is to the left of edge $P_1P_2$ and is unvisited. Therefore, traversal edge $P_1P_2$ generates a hole. Similarly, at event point $M_1$, edge $M_1M_2$ is an odd edge and on the left edge $V_1V_7$ has been visited, therefore, traversal edge $M_1M_2$ generates the outer edge of a new polygonal object.

Rule 1: Segment traversal in each segment pool starts from an unvisited odd-segment at each event point where the even/odd attribute of a segment is determined as when alternate edge filling rules are applied. Each segment can only be visited once and all segments in the pool must be visited. For example, the arrowed lines in FIG. 10 indicate the starting segments at event points $V_1$, $P_1$ and $M_1$.

Rule 2: If there is an unvisited even numbered segment on the left of an odd numbered segment emanating from the same event point at the start of a traversal, the traversal path forms a hole. Oppositely, if the segment on the left of an odd numbered segment is visited, the traversal path forms the outer edge of a polygonal object (see example in FIG. 10).

Figure 11:
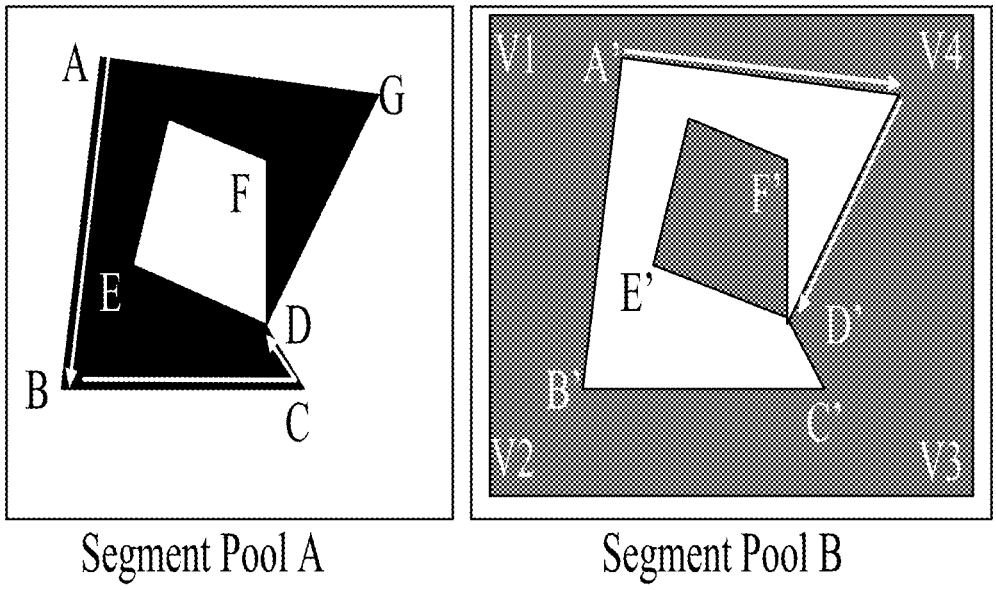
FIG. 11: The left side shows an outline traversal in segment pool A. At vertex D, there are three edges that can be chosen: edge DE, DF and edge DG. Since the traversal started at event point A indicates an outer edge and DE is the leftmost of the three edges (DE, DG and DG) it is chosen. A hole traversal in a segment pool B is shown on the right. At vertex D', there are three edges that can be chosen: D'E', D'F' and D'C'. Because the traversal path starting at A' indicates a hole, the rightmost edge D'C' is chosen.
Figure 12:
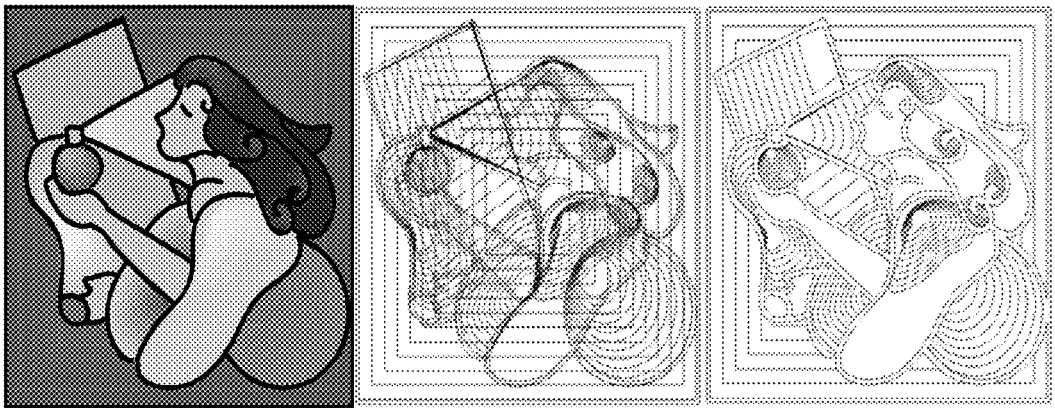
FIG. 12: Example graphics metafile. Left: original metafile image, Middle: wire-frame outlines of original metafile records, Right: wire-frame outlines of composite result.
Figure 13:
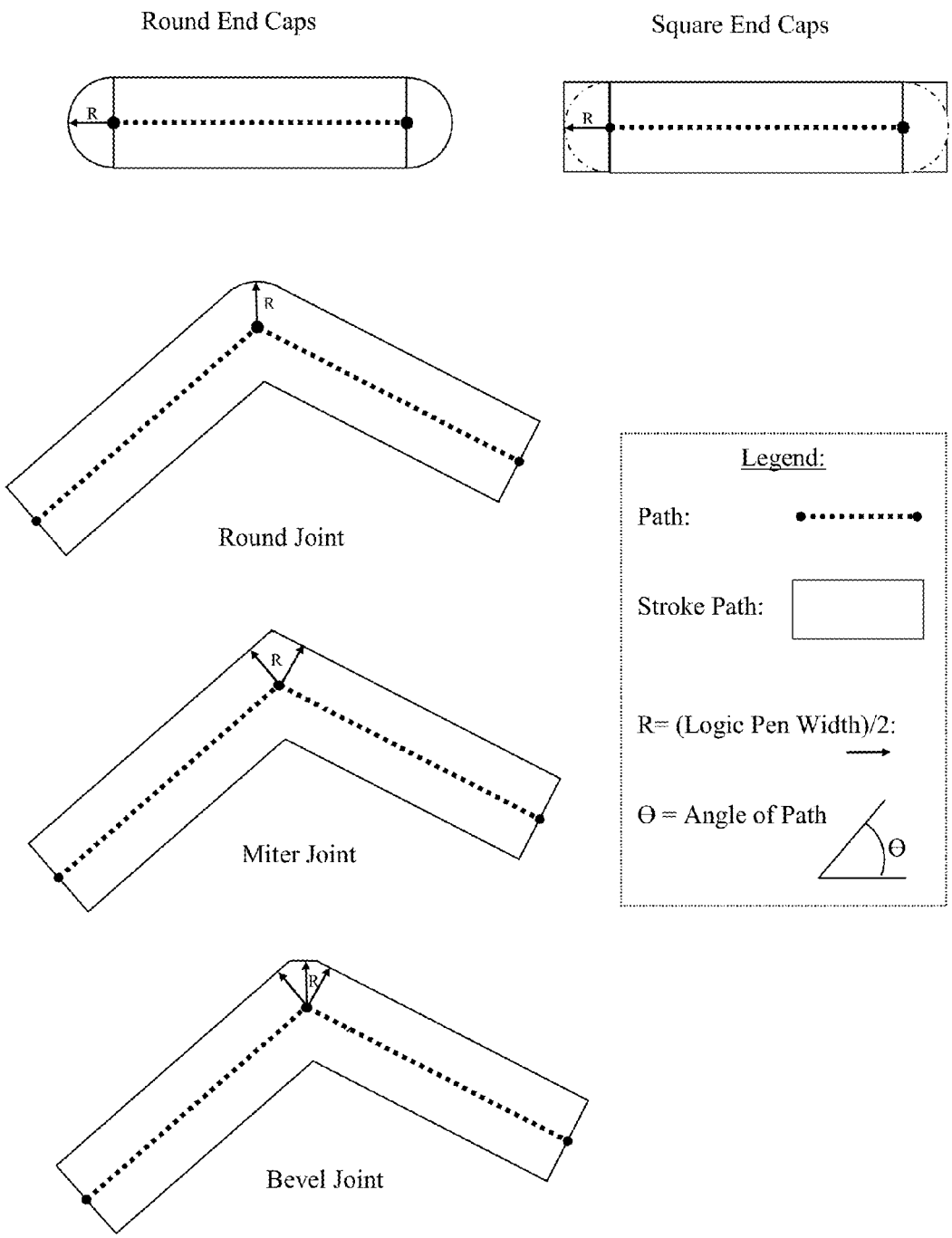
FIG. 13: Illustration of example end-cap types and join types.

Rule 3: At each vertex during traversal, if there are two or more edges unvisited, the leftmost edge is chosen if the traversal is along an outside boundary whereas the rightmost edge is chosen if it is a hole (as previously determined using rules 1 & 2). FIG. 11 shows how this rule is applied.

In addition to pool attributes (i.e. pool ID, color etc.), each segment is also associated with its twin segment which is stored in a different pool (analogous to the two half edges that comprise any edge). This association allows border information to be constructed for each object when a traversal is performed in each segment pool. More specifically, the twin segment's attributes are checked during the traversal. If the twin segment's attribute information is changed (e.g. the adjacent object with which this object borders has changed), the starting point of the edge is flagged as an "Adjacent Object Transfer Point." And the border ID is set to is twin segment ID (where ID's are uniquely assigned to every resultant object generated). This border information basically specifies exactly where objects are touching or adjacent to other objects and can be quite useful when generating embroidery data. For example, to ensure solid registration (with no visible gap between adjacent objects) it may be useful to modify the embroidery generated for one object (appearing earlier in a sewing sequence) such that it extends or partially overlaps underneath another object to be sewn later in a sewing sequence only where the two objects are adjacent to one another. This will ensure that even if some visible shrinkage is present in the embroidered representation (i.e. due to stitch tension, etc.), the two objects will still be visibly adjacent to each other with no apparent gap. This auto-overlap type feature is difficult to facilitate if border information is not generated for each object.

After MC method is executed, embroidery primitive data generation can proceed by translating objects into specific embroidery stitching pattern. One embodiment of this method executes as disclosed in U.S. Pat. No. 6,397,120, No. 6,804,573, No. 6,836,695 and No. 6,947,808 where embroidery primitive control points are generated based on the geometric properties of the related shapes. Common border information (as mentioned above and referred to within the patents) further guides this process. After control points are generated, the actual x,y coordinates of stitch end points are produced by a stitch generation method. These end-points may then be easily reformed into any one of dozens of different proprietary machine file formats for viewing in editing programs or direct download for production on actual embroidery sewing equipment.

What is claimed is:

1. A method, comprising:

sweeping a scan line over line segments from different ones of first polygonal objects;

identifying an event point via the scan line;

evaluating the line segments in response to identifying the event point to identify an intersection of at least two of the line segments from different ones of the first polygonal objects;

determining relationships between the line segments based on the intersection, wherein determining the relationships between the line segments comprises determining segment pairs of the line segments, and wherein each segment pair comprises two segments located on different edges of a region and which intersect the scan line;

removing a redundancy between the at least two of the line segments;

generating, using a computer, second polygonal objects based on the intersection and the at least two line segments; and outputting, from the computer, embroidery data representative of the second polygonal objects.

2. A method as defined in claim 1, wherein evaluating the line segments comprises determining whether a first one of the line segments associated with the event point is to be moved into a first segment pool sharing at least one attribute with the first one of the line segments, copied into a second segment pool having no shared attributes with the first one of the line segments, or not placed into any segment pool.

3. A method as defined in claim 1, further comprising removing at least one of a first point on a first one of the line segments when the first point is coincident with a second point on a second one of the line segments.

4. A method as defined in claim 1, wherein determining the relationships between the line segments comprises organizing the line segments into segment pools, the segment pools comprising line segments having at least one shared attribute per segment pool.

5. A method as defined in claim 4, wherein generating the second polygonal objects comprises generating one of the second polygonal objects using the line segments in a corresponding one of the segment pools.

6. A method as defined in claim 1, wherein sweeping the scan line comprises sweeping the scan line from a first end of an area including the first polygonal objects in a direction toward a second end of the area opposite the first end.

7. A method as defined in claim 1, wherein the evaluating occurs each time the scan line intersects an event point.

8. A method, comprising:

receiving line segments as vector data from a printer subsystem of a computer;

identifying intersections of the line segments from different ones of first polygonal objects;

determining relationships between the line segments based on the intersections;

removing a redundancy between at least two of the line segments;

generating, using a computer, second polygonal objects based on the intersections and line segments; and outputting, from the computer, embroidery data representative of the second polygonal objects.

9. An apparatus, comprising:

a processor; and a memory coupled to the processor, the memory comprising instructions which, when executed by the processor, cause the processor to at least:

sweep a scan line over line segments from different ones of first polygonal objects;

identify an event point via the scan line;

evaluate the line segments in response to identifying the event point to identify an intersection of at least two of the line segments from different ones of the first polygonal objects;

determine relationships between the line segments based on the intersection, wherein determining the relationships between the line segments comprises determining segment pairs of the line segments, and wherein each segment pair comprises two segments located on different edges of a region and which intersect the scan line;

remove a redundancy between the at least two of the line segments;

generate second polygonal objects based on the intersection and the at least two the line segments; and output embroidery data representative of the second polygonal objects.

10. An apparatus as defined in claim 9, wherein evaluating the line segments comprises determining whether a first one of the line segments associated with the event point is to be moved into a first segment pool sharing at least one attribute with the first one of the line segments, copied into a second segment pool having no shared attributes with the first one of the line segments, or not placed into any segment pool.

11. An apparatus as defined in claim 9, wherein the instructions further cause the processor to remove at least one of a first point on a first one of the line segments when the first point is coincident with a second point on a second one of the line segments.

12. An apparatus as defined in claim 9, wherein determining the relationships between the line segments comprises organizing the line segments into segment pools, the segment pools comprising line segments having at least one shared attribute per segment pool.

13. An apparatus as defined in claim 12, wherein generating the second polygonal objects comprises generating one of the second polygonal objects using the line segments in a corresponding one of the segment pools.

14. An apparatus comprising:

a processor; and a memory coupled to the processor, the memory comprising instructions which, when executed by the processor, cause the processor to:

access line segments as vector data from a printer subsystem of a computer;

identify intersections of line segments from different ones of first polygonal objects;

determine relationships between the line segments based on the intersections;

remove a redundancy between at least two of the line segments;

generate second polygonal objects based on the intersections and the line segments; and output embroidery data representative of the second polygonal objects.

15. A non-transitory article of manufacture comprising machine readable instructions stored on a computer readable medium which, when executed, cause a computer to at least:

sweep a scan line over line segments from different ones of first polygonal objects;

identify an event point via the scan line;

evaluate the line segments in response to identifying the event point to identify an intersection of at least two of the line segments from different ones of the first polygonal objects;

determine relationships between the line segments based on the intersection, wherein determining the relationships between the line segments comprises determining segment pairs of the line segments, and wherein each segment pair comprises two segments located on different edges of a region and which intersect the scan line;

remove a redundancy between the at least two of the line segments;

generate second polygonal objects based on the intersections intersection and the at least two the line segments; and output embroidery data representative of the second polygonal objects.

16. A method, comprising:

sweeping a scan line over line segments from different ones of first polygonal objects;

identifying an event point via the scan line, wherein sweeping the scan line comprises evaluating a plurality of event points in order according to a first coordinate value and then a second coordinate value;

evaluating the line segments in response to identifying the event point to identify an intersection of at least two of the line segments from different ones of the first polygonal objects;

determining relationships between the line segments based on the intersection;

removing a redundancy between the at least two of the line segments;

generating, using a computer, second polygonal objects based on the intersection and the at least two line segments; and outputting, from the computer, embroidery data representative of the second polygonal objects.

* * * * *